US010165632B2

(12) United States Patent
Jin et al.

(10) Patent No.: US 10,165,632 B2
(45) Date of Patent: Dec. 25, 2018

(54) LIGHT-EMITTING DIODE DRIVING MODULE, METHOD OF OPERATING THEREOF, AND LIGHTING APPARATUS INCLUDING THE SAME

(71) Applicant: Seoul Semiconductor Co., Ltd., Ansan-si (KR)

(72) Inventors: SungHo Jin, Ansan-si (KR); HyungJin Lee, Ansan-si (KR); SangWook Han, Ansan-si (KR)

(73) Assignee: Seoul Semiconductor Co., Ltd., Ansan-si (KR)

( * ) Notice: Subject to any disclaimer, the term of this patent is extended or adjusted under 35 U.S.C. 154(b) by 0 days.

(21) Appl. No.: 15/946,993

(22) Filed: Apr. 6, 2018

(65) Prior Publication Data

US 2018/0295684 A1 Oct. 11, 2018

(30) Foreign Application Priority Data

Apr. 7, 2017 (KR) ..... 10-2017-0045291
Apr. 24, 2017 (KR) ..... 10-2017-0052430

(51) Int. Cl.
*H05B 33/08* (2006.01)
*H05B 41/39* (2006.01)
*H05B 41/392* (2006.01)

(52) U.S. Cl.
CPC ..... *H05B 33/0809* (2013.01); *H05B 33/0815* (2013.01); *H05B 33/0824* (2013.01); (Continued)

(58) Field of Classification Search
CPC ..... H05B 33/0815; H05B 33/0845; H05B 33/0809; H05B 33/0824; H05B 33/0827; (Continued)

(56) References Cited

U.S. PATENT DOCUMENTS 6,057,651 A 5/2000 Usami
6,094,014 A 7/2000 Bucks et al.
(Continued)

FOREIGN PATENT DOCUMENTS

JP 10-321914 12/1998
JP 2001-244097 9/2001
WO 2016/093534 6/2016

OTHER PUBLICATIONS

European Search Report, dated Jul. 24, 2018, in European Patent Application No. 18166172.9.

*Primary Examiner* — Vibol Tan
(74) *Attorney, Agent, or Firm* — H.C. Park & Associates, PLC

(57) ABSTRACT

A light-emitting diode driving module includes an LED driving circuit to activate light-emitting diodes driven by a rectified voltage, and to adjust driving current conducted through driving nodes to the light-emitting diodes depending on a voltage of a driving current setting node; and a driving current controller to control the voltage of the driving current setting node by outputting a driving current control signal. The driving current controller includes a control signal output circuit connected to a dimming node to receive a dimming signal when the rectified voltage is modulated, and to adjust the driving current control signal depending on the dimming signal; a mode detector to detect whether the rectified voltage is modulated by receiving a source voltage depending on the rectified voltage, and to enable a selection signal depending on a detection result; and a power compensator to adjust the driving current control signal when the selection signal is enabled.

20 Claims, 30 Drawing Sheets

(52) U.S. Cl.
CPC ..... *H05B 33/0827* (2013.01); *H05B 33/0845* (2013.01); *H05B 33/0887* (2013.01); *H05B 41/3924* (2013.01); *H05B 41/3927* (2013.01)

(58) Field of Classification Search
CPC ..... H05B 33/083; H05B 33/0887; H05B 41/3924; H05B 41/3927; H05B 37/02; H05B 39/02; Y02B 20/346; Y02B 20/347; Y10S 315/04; H02M 3/33507; H02M 2001/0006
See application file for complete search history.

(56) References Cited

U.S. PATENT DOCUMENTS 6,586,890 B2 7/2003 Min et al.
6,989,807 B2 1/2006 Chiang
7,038,399 B2 5/2006 Lys et al.
7,081,722 B1 7/2006 Huynh
7,262,559 B2 8/2007 Tripathi et al.
7,352,138 B2 4/2008 Lys et al.
7,781,979 B2 8/2010 Lys
8,102,167 B2 * 1/2012 Irissou ..... H05B 39/08 315/194
8,390,214 B2 3/2013 Van Laanen et al.
8,493,004 B2 7/2013 Sauerlaender
8,558,518 B2 * 10/2013 Irissou ..... H05B 39/08 315/194
8,587,211 B2 * 11/2013 Melanson ..... H05B 33/0815 315/185 S
9,084,316 B2 * 7/2015 Melanson ..... H02M 1/4225
9,167,662 B2 * 10/2015 King ..... H05B 37/02
9,178,444 B2 11/2015 Maru et al.
9,214,862 B2 * 12/2015 Mazumdar ..... H02M 3/156
9,282,610 B2 * 3/2016 Kuang ..... H05B 33/0815
9,369,116 B2 6/2016 Nederbragt et al.
9,491,845 B2 * 11/2016 Melanson ..... H05B 33/0854
9,497,851 B2 * 11/2016 Melanson ..... H05B 33/0854
9,622,312 B2 * 4/2017 Takahashi ..... H05B 33/0818
9,693,413 B2 6/2017 Lys
2013/0049622 A1 2/2013 Angeles
2013/0193866 A1 8/2013 Datta et al.
2013/0313984 A1 11/2013 Maiwald

* cited by examiner

LIGHT-EMITTING DIODE DRIVING MODULE, METHOD OF OPERATING THEREOF, AND LIGHTING APPARATUS INCLUDING THE SAME

CROSS REFERENCE TO RELATED APPLICATIONS

This application claims priority from and the benefit of Korean Patent Application No. 10-2017-0045291, filed on Apr. 7, 2017, and Korean Patent Application No. 10-2017-0052430, filed on Apr. 24, 2017, which are hereby incorporated by reference for all purposes as if fully set forth herein.

BACKGROUND

Field

Exemplary implementations of the invention relate generally to an electronic device, and, more specifically, to a light-emitting diode driving module for driving light-emitting diodes, an operating method thereof and a lighting apparatus including the same.

Discussion of the Background

In order to drive light-emitting diodes (LEDs) using a rectified voltage, a lighting apparatus including light-emitting diodes may convert an AC voltage into a rectified voltage and may cause the light-emitting diodes to emit light depending on the level of the rectified voltage.

Recently, lighting apparatus which not only provides a predetermined light output but also supports a dimming function capable of providing various levels of light outputs according to a user's needs has been developed. However, since the light-emitting diodes are driven by using the rectified voltage, problems may be caused in that it is not easy to realize the dimming function and it is difficult to secure the linearity of the amount of light according to dimming control. Also, a user may require or may not require such a dimming function.

Another common problem that arises in LED lighting having a dimming function is the lack of an adequate solution to the problem of flicker. When a consumer turns a dimmer control down to a low voltage to dim the LEDs, but does not turn the LED's all the way off, the common phenomena of light flicker occurs.

Accordingly, there is a need in the art for lighting apparatus capable of adaptively covering both a case where a user requires the dimming function and a case where a user does not require the dimming function. There also is a need for better control of LED lighting using dimmers to avoid flicker and similar problems.

The above information disclosed in this Background section is only for understanding of the background of the inventive concepts, and, therefore, it may contain information that does not constitute prior art.

SUMMARY

Devices constructed according to the principles and exemplary implementations of the invention and operating methods thereof are capable of adaptively covering applications where a dimming function is used and applications where the dimming function is not used without user intervention. For example, according to the principles and exemplary implementations of the invention, a circuit may be provided to detect automatically whether or not a dimmer is being employed during operation.

According to another aspect of the invention, light-emitting diode driving modules constructed according to the principles and exemplary implementations of the invention and operating methods thereof may employ a circuit to automatically prevent flicker without user intervention. For example, the circuit may include a hysteresis comparator operable to blocking current to the driving nodes of the LEDs when a dimming level of the dimming signal decreases lower than a first threshold value and unblock current to the driving nodes when the dimming level of the dimming signal increases above a second threshold value higher than the first threshold value.

Light-emitting diode driving modules constructed according to the principles and exemplary implementations of the invention and operating methods thereof also have constant power consumption and improved durability.

In addition, light-emitting diode driving modules constructed according to exemplary implementations of the invention, operating methods thereof, and lighting apparatus including the same have improved operational reliability.

Additional features of the inventive concepts will be set forth in the description which follows, and in part will be apparent from the description, or may be learned by practice of the inventive concepts.

According to one or more exemplary implementations of the invention, a light-emitting diode driving module may include: an LED driving circuit to activate light-emitting diodes driven by a rectified voltage, and to adjust driving current conducted through driving nodes to the light-emitting diodes depending on a voltage of a driving current setting node; and a driving current controller to control the voltage of the driving current setting node by outputting a driving current control signal, the driving current controller including a control signal output circuit connected to a dimming node to receive a dimming signal when the rectified voltage is modulated, and to adjust the driving current control signal depending on the dimming signal; a mode detector to detect whether the rectified voltage is modulated by receiving a source voltage depending on the rectified voltage, and to enable a selection signal depending on a detection result; and a power compensator to adjust the driving current control signal depending on the source voltage when the selection signal is enabled.

The mode detector may be configured to disable the selection signal when the rectified voltage is modulated and enable the selection signal when the rectified voltage is not modulated.

The mode detector may be configured to detect whether the rectified voltage is modulated, depending on a variation rate of the source voltage.

The mode detector may disable the selection signal when the variation rate of the source voltage is lower than a threshold value, and enable the selection signal when the variation rate of the source voltage is higher than or equal to the threshold value.

The power compensator may be configured to adjust the driving current control signal depending on a peak value of the source voltage.

The power compensator may be configured to adjust the driving current control signal such that the voltage of the driving current setting node decreases as the peak value increases.

The power compensator may be configured to adjust the driving current control signal such that the voltage of the driving current setting node decreases as the peak value increases, when the peak value is higher than a reference value.

The power compensator may is configured to apply a control current which varies depending on the peak value, to the control signal output circuit, and the control signal output circuit may be configured to adjust the driving current control signal depending on a level of the control current.

The dimming node may be floated when the rectified voltage is not modulated.

The light-emitting diode driving module may further include a driving current setting circuit to control the voltage of the driving current setting node depending on a voltage level of the driving current control signal.

The light-emitting diode driving module may further include a DC power source to generate a DC voltage based upon the rectified voltage. The driving current setting circuit may include a voltage adjuster connected between the DC power source and the driving current setting node to apply a current, which varies depending on a voltage of the driving current control signal, to the driving current setting node.

The driving current setting node may be connected to a ground node through a resistor.

The LED driving circuit may include a first transistor connected between a first driving node of the driving nodes and a first source node; a first comparator including a non-inverting terminal connected to the driving current setting node, an inverting terminal connected to the first source node and an output terminal connected to a gate of the first transistor; a second transistor connected between a second driving node of the driving nodes and a second source node; and a second comparator including a non-inverting terminal connected to the driving current setting node, an inverting terminal connected to the second source node and an output terminal connected to a gate of the second transistor. Each of the first and second source nodes may be connected to a ground node through at least one resistor.

The light-emitting diode driving module may further include a temperature detector to detect temperature in response to generation of a power-on reset signal, and to output a temperature detection signal when the temperature is higher than a pre-determined temperature limit. The driving current control signal may be adjustable depending on the temperature detection signal.

The driving current control signal may be adjusted such that the voltage of the driving current setting node is retained at a predetermined level when the temperature detection signal is enabled.

The source voltage may include a divided voltage based upon the rectified voltage.

According to one or more exemplary implementations of the invention, a method for driving light-emitting diodes activated by a rectified voltage and are controlled through driving nodes includes the steps of: determining whether the rectified voltage is modulated, by receiving a source voltage based on the rectified voltage; when the rectified voltage is not modulated, adjusting currents through the driving nodes based on the source voltage; and when the rectified voltage is modulated, adjusting currents conducted to the driving nodes in response to a dimming signal that indicates a degree of modulation of the rectified voltage, without adjusting current conducted to the driving nodes based on the source voltage.

The step of determining that the rectified voltage is modulated may include determining that a variation rate of the source voltage is higher than a threshold value, and the step of determining that the rectified voltage is not modulated may include determining that a variation rate of the source voltage is lower than or equal to the threshold value.

According to one or more exemplary implementations of the invention, a lighting apparatus includes: a light-emitting circuit to receive a rectified voltage, and including light-emitting diodes and a capacitor connected with the light-emitting diodes; and a light-emitting diode driving module connected with the light-emitting circuit through driving nodes. The light-emitting diode driving module may include an LED driver to adjust currents conducted to the driving nodes depending on a voltage of a driving current setting node; and a driving current controller to control the voltage of the driving current setting node by outputting a driving current control signal, the driving current controller including a control signal output circuit connected to a dimming node to receive a dimming signal when the rectified voltage is modulated, and to adjust the driving current control signal depending on the dimming signal; a mode detector to detect whether the rectified voltage is modulated, by receiving a source voltage depending on the rectified voltage, and to enable a selection signal depending on a detection result; and a power compensator to adjust the driving current control signal depending on the source voltage, when the selection signal is enabled.

The LED driver may have a first driving stage during first periods of the rectified voltage to apply a current from the rectified voltage to at least one of the light-emitting diodes and the capacitor, and a second driving stage to apply a current from the capacitor to the at least one of the light-emitting diodes, and during a second period of the rectified voltage before the first periods, the LED driver may be configured to perform the first driving stage, without performing the second driving stage.

The LED driver may have a third driving stage during the first periods of the rectified voltage to apply a current from the rectified voltage to the light-emitting diodes, and during the second period of the rectified voltage, the LED driver may be configured to perform the first driving stage, without performing the third driving stage.

According to one or more exemplary implementations of the invention, a light-emitting diode driving module includes: an LED driving circuit to activate light-emitting diodes driven by a modified rectified voltage, and to adjust driving currents conducted to driving nodes to the light emitting diodes; a driving current controller to receive a dimming signal indicative of a degree of modulation of the rectified voltage, and to control currents conducted to the driving nodes depending on the dimming signal; and a current blocking circuit to block the currents of the driving nodes when a dimming level of the dimming signal decreases lower than a first threshold value, and unblock the currents of the driving nodes when the dimming level increases above a second threshold value higher than the first threshold value.

The current blocking circuit may enable a blocking signal when the dimming level of the dimming signal decreases lower than the first threshold value, and disable the blocking signal when the dimming level increases above the second threshold value. The current conducted to the driving nodes may be blocked when the blocking signal is enabled.

The LED driving circuit may be connected to a driving current setting node to adjust the current conducted to the driving nodes depending on a voltage of the driving current setting node, and the driving current controller may be configured to control the voltage of the driving current setting node depending on the dimming signal. The light-emitting diode driving module may further include a voltage detection circuit configured to block the currents of the driving nodes when the voltage of the driving current setting node is higher than a first threshold voltage.

The voltage detection circuit may be configured to block the currents of the driving nodes when the voltage of the driving current setting node increases higher than the first threshold voltage, and unblock the currents of the driving nodes when the voltage of the driving current setting node decreases below a second threshold voltage lower than the first threshold voltage.

The light-emitting diode driving module may further include a DC power source to generate a DC voltage based on the rectified voltage. The DC voltage may be connected to an output node to supply DC voltage outside the light-emitting diode driving module. The light-emitting diode driving module may further include a current detection circuit to block the current conducted to the driving nodes when a current of the output node is higher than a first threshold current.

The current detection circuit may be configured to block the current conducted to the driving nodes when the current of the output node increases higher than the first threshold current, and unblock the current conducted to the driving nodes when the current of the output node decreases lower than a second threshold current lower than the first threshold current.

The light-emitting diode driving module may further include a detector having a resistor-capacitor integrator circuit to sense a dimming level. The detector may output the dimming signal by integrating the rectified voltage.

The dimming level may include a voltage level of the dimming signal.

The light-emitting diode driving module may further include a phase detector to output a dimming phase signal when the rectified voltage is equal to or higher than a predetermined level; and a pulse counter to receive a clock signal and count pulses of the clock signal which toggles when the dimming phase signal is outputted. The dimming signal may be indicative of a number of the counted pulses.

The dimming level may include the count of the counted pulses.

According to one or more exemplary implementations of the invention, a method for driving dimmable, light-emitting diodes activated by a modulated rectified voltage and controlled through driving nodes includes the steps of: receiving a dimming signal indicative of a degree of modulation of the rectified voltage; driving the light-emitting diodes by controlling current conducted to the driving nodes depending on the dimming signal; blocking the current conducted to the driving nodes when a dimming level of the dimming signal decreases lower than a first threshold value; and unblocking the current conducted to the driving nodes when the dimming level of the dimming signal increases above than a second threshold value higher than the first threshold value.

The step of the driving of the light-emitting diodes by controlling currents depending on the dimming signal may include controlling a voltage of a driving current setting node based on the dimming signal, and adjusting the current conducted to the driving nodes depending on the voltage of the driving current setting node.

The method may further include the step of blocking the current conducted to the driving nodes when the voltage of the driving current setting node is higher than a first threshold voltage.

The method may further include the step of unblocking the current conducted to the driving nodes when the voltage of the driving current setting node decreases below a second threshold voltage lower than the first threshold voltage.

The method may further include the step of generating a DC voltage by using the rectified voltage and supplying the DC voltage to an output node; and blocking the current conducted to the driving nodes when a current of the output node is higher than a first threshold current.

The method may further include the step of blocking the current conducted to the driving nodes when the current of the output node increases higher than the first threshold current, and unblocking the current conducted to the driving nodes when the current of the output node decreases below a second threshold current lower than the first threshold current.

According to one or more exemplary implementations of the invention, a dimmable, lighting apparatus includes: light-emitting diodes configured to receive a modulated rectified voltage; and a light-emitting diode driving module connected to the light-emitting diodes through driving nodes. The light-emitting diode driving module may include an LED driving circuit to drive the light-emitting diodes by applying currents to the driving nodes depending on a level of the rectified voltage; a driving current controller to receive a dimming signal indicative of a degree of modulation of the rectified voltage, and to control the current conducted to the driving nodes depending on the dimming signal; and a current blocking circuit to block the current conducted to the driving nodes when a dimming level of the dimming signal decreases lower than a first threshold value, and to unblock the current conducted to the driving nodes when the dimming level increases above a second threshold value higher than the first threshold value.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
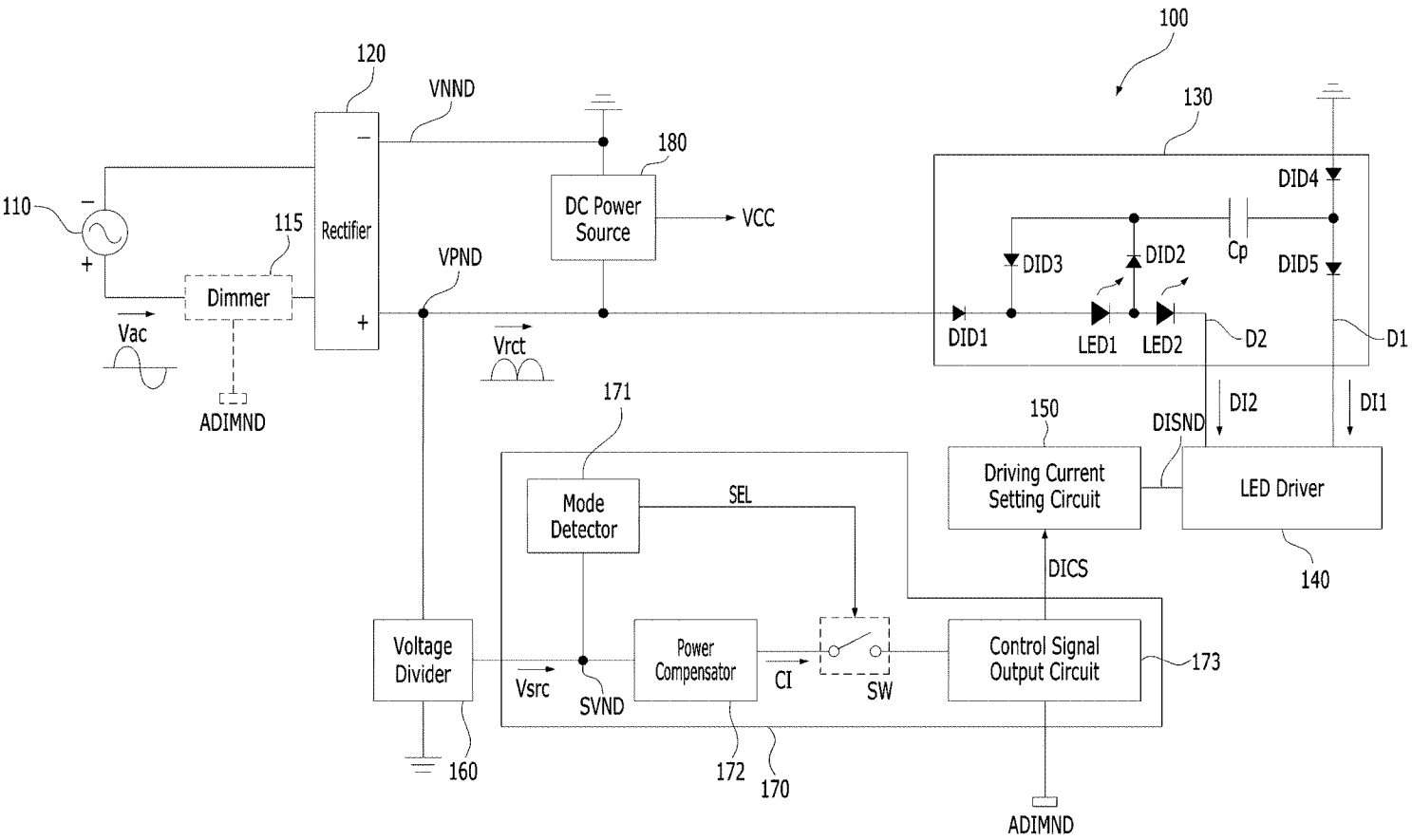
FIG. 1 is a block diagram illustrating of a lighting apparatus constructed in accordance with an exemplary embodiment of the invention.

In the following description, for the purposes of explanation, numerous specific details are set forth in order to provide a thorough understanding of various exemplary embodiments or implementations of implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Figure 2A:
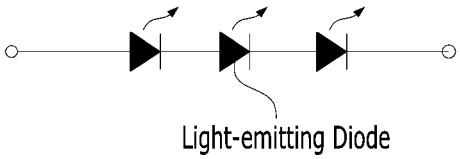
FIGS. 2A, 2B, 2C and 2D are circuit diagrams illustrating exemplary embodiments of the light-emitting diode group of FIG. 1.
Figure 2B:
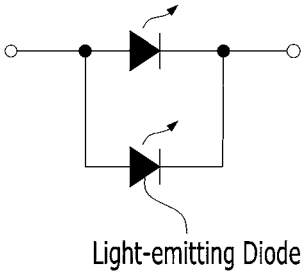
Figure 2C:
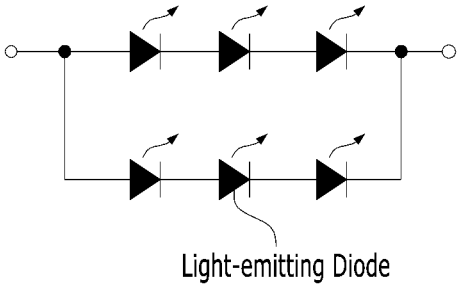
Figure 2D:
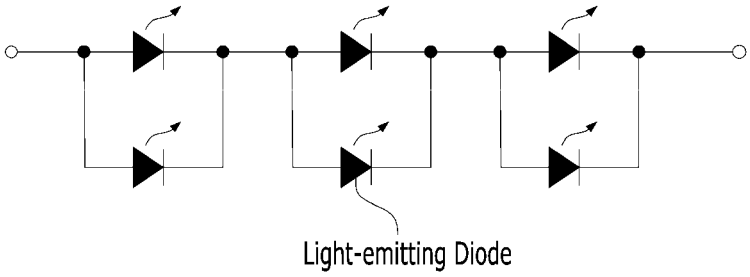
Figure 3:
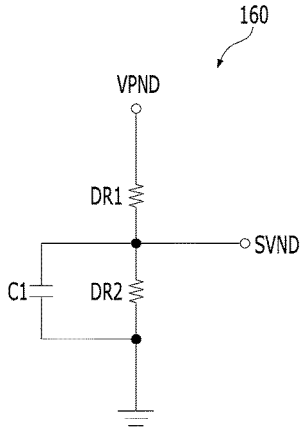
FIG. 3 is a circuit diagram illustrating an embodiment of the voltage divider of FIG. 1.

FIG. 1 is a block diagram illustrating of a lighting apparatus constructed in accordance with an exemplary embodiment of the invention. FIGS. 2A, 2B, 2C and 2D are circuit diagrams illustrating exemplary embodiments of the light-emitting diode group of FIG. 1. FIG. 3 is a circuit diagram illustrating an embodiment of the voltage divider 160 of FIG. 1.

Referring to FIG. 1, the lighting apparatus 100 may be connected to an AC power source 110 and receive an AC voltage Vac, and may include a rectifier 120, a light-emitting circuit 130, an LED driver 140, a driving current setting circuit 150, the voltage divider 160, a driving current controller 170 and a DC power source 180.

The lighting apparatus 100 may further include a dimmer 115 depending on a user's choice. The dimmer 115 may receive the AC voltage Vac from the AC power source 110, modulate the AC voltage Vac to have a dimming level according to a user's selection, and output a modulated AC voltage.

In an embodiment, the dimmer 115 may be implemented as a triac dimmer, which cuts the phase of the AC voltage Vac by using a triac, a pulse width dimmer which modulates the pulse width of the AC voltage Vac, or other dimmers known in the art.

In the case where the dimmer 115 is a triac dimmer, the dimmer 115 may output a modulated AC voltage by cutting the phase of the AC voltage Vac based on a dimming level selected by a user. In the case where the dimmer 115 is a triac dimmer, control over a triac trigger current may be required. To this end, the lighting apparatus 100 may further include a bleeder circuit which is connected between the dimmer 115 and the rectifier 120. The bleeder circuit may include, for example, a bleeder capacitor and a bleeder resistor In FIG. 1, the dimmer 115 is provided as a component of the lighting apparatus 100. However, it is to be noted that embodiments of the invention are not limited thereto. The dimmer 115 may be disposed outside the lighting apparatus 100 and be electrically connected with the lighting apparatus 100.

The rectifier 120 is configured to rectify the AC voltage Vac or the AC voltage modulated by the dimmer 115 and output a rectified voltage Vrct through a first power node VPND and a second power node VNND. The rectified voltage Vrct is outputted to the light-emitting circuit 130 and the voltage divider 160.

In an embodiment, the lighting apparatus 100 may further include a surge protection circuit which is configured to protect internal components of the lighting apparatus 100 from an overvoltage and/or an overcurrent. The surge protection circuit may be connected, for example, between the first and second power nodes VPND and VNND.

The light-emitting circuit 130 is connected between the first and second power nodes VPND and VNND. The light-emitting circuit 130 operates according to the control of the LED driver 140. The light-emitting circuit 130 may include a first light-emitting diode group LED1, a second light-emitting diode group LED2 and a capacitor Cp. While it is illustrated in FIG. 1 that the light-emitting circuit 130 includes the two light-emitting diode groups LED1 and LED2 and the capacitor Cp, it is to be noted that embodiments of the invention are not limited thereto and the number of light-emitting diode groups and the number of capacitors may be changed variously.

Each of the first and second light-emitting diode groups LED1 and LED2 may include one or more light-emitting diodes. The number of light-emitting diodes included in each light-emitting diode group and the connection relationship of the light-emitting diodes may be changed variously. Exemplary embodiments of each light-emitting diode group are shown in FIGS. 2A to 2D. Referring to FIG. 2A, each light-emitting diode group may include a plurality of light-emitting diodes which are connected in series. Referring to FIG. 2B, each light-emitting diode group may include a plurality of light-emitting diodes which are connected in parallel. Referring to FIG. 2C, each light-emitting diode group may include sub groups which are connected in parallel, and each sub group may include a plurality of light-emitting diodes which are connected in series. Referring to FIG. 2D, each light-emitting diode group may include sub groups which are connected in series, and each sub group may include a plurality of light-emitting diodes which are connected in parallel. According to these embodiments, the first light-emitting diode group LED1 and the second light-emitting diode group LED2 may have the same forward voltage or may have different forward voltages. A forward voltage is a threshold voltage capable of driving a corresponding light-emitting diode group.

Referring again to FIG. 1, the first and second light-emitting diode groups LED1 and LED2 may be connected in series between the first power node VPND and a second driving node D2. The capacitor Cp may be connected between the output terminal of the first light-emitting diode group LED1 (or the input terminal of the second light-emitting diode group LED2) and a first driving node D1. The capacitor Cp may be charged and discharged depending on the level of the rectified voltage Vrct, and may provide a current to at least one of the first and second light-emitting diode groups LED1 and LED2 when being discharged. By the presence of the capacitor Cp, the first and second light-emitting diode groups LED1 and LED2 may emit light even through the level of the rectified voltage Vrct becomes low.

In an embodiment, the light-emitting circuit 130 may further include first to fifth diodes DID1 to DID5 for preventing backflow. The first diode DID1 is connected between the first power node VPND and the first light-emitting diode group LED1, and blocks the current flowing from the first light-emitting diode group LED1 to the first power node VPND. The second diode DID2 is connected between the output terminal of the first light-emitting diode group LED1 (or the input terminal of the second light-emitting diode group LED2) and the capacitor Cp, and blocks the current flowing from the capacitor Cp to the output terminal of the first light-emitting diode group LED1. The third diode DID3 is connected between the capacitor Cp and the input terminal of the first light-emitting diode group LED1, and blocks the current flowing from the input terminal of the first light-emitting diode group LED1 to the capacitor Cp. The fourth and fifth diodes DID4 and DID5 are connected between a ground node (that is, the second power node VNND) and the first driving node D1, and a branch node between the fourth and fifth diodes DID4 and DID5 is connected to the capacitor Cp. The fourth diode DID4 blocks the current flowing from the corresponding branch node to the ground node, and the fifth diode DID5 blocks the current flowing from the first driving node D1 to the corresponding branch node.

The LED driver 140 is connected to the light-emitting circuit 130 through the first and second driving nodes D1 and D2. The LED driver 140 is configured to drive the light-emitting circuit 130 by applying first and second driving currents DI1 and DI2 to the first and second driving nodes D1 and D2, respectively. As the level of each driving current is high, the light amount of a light-emitting diode group through which the corresponding driving current flows increases.

The LED driver 140 adjusts the respective levels of the first and second driving currents DI1 and DI2 depending on the voltage of a driving current setting node DISND. When the voltage of the driving current setting node DISND increases, the LED driver 140 may increase the levels of the first and second driving currents DI1 and DI2. When the voltage of the driving current setting node DISND decreases, the LED driver 140 may decrease the levels of the first and second driving currents DI1 and DI2.

The driving current setting circuit 150 adjusts the voltage of the driving current setting node DISND depending on a driving current control signal DICS. The voltage of the driving current setting node DISND may be a DC voltage. In an embodiment, the driving current setting circuit 150 may include at least one setting resistor for causing the voltage of the driving current setting node DISND to fall within a desired voltage range.

It is to be understood that the relationship between the voltage level of the driving current control signal DICS and the voltage level of the driving current setting node DISND may be changed depending on the internal components of the driving current setting circuit 150. For example, the driving current setting circuit 150 may decrease the voltage of the driving current setting node DISND as the voltage of the driving current control signal DICS decreases. As another example, the driving current setting circuit 150 may decrease the voltage of the driving current setting node DISND as the voltage of the driving current control signal DICS increases. Hereinbelow, it is assumed for the sake of convenience in explanation that the driving current setting circuit 150 is configured to decrease the voltage of the driving current setting node DISND as the voltage of the driving current control signal DICS decreases.

The voltage divider 160 is connected between the first power node VPND and the ground node (that is, the second power node VNND). The voltage divider 160 is configured to divide the rectified voltage Vrct of the first power node VPND and output a source voltage Vsrc to a source voltage node SVND. By using the voltage divider 160, a relatively low voltage may be applied to the driving current controller 170.

Referring to FIG. 3, the voltage divider 160 includes a first dividing resistor DR1 which is connected between the first power node VPND and the source voltage node SVND and a second dividing resistor DR2 which is connected between the source voltage node SVND and the ground node. The voltage divider 160 may further include a first capacitor C1 which is connected between the source voltage node SVND and the ground node to eliminate the noise of the source voltage Vsrc.

Referring back to FIG. 1, the driving current controller 170 is connected to the source voltage node SVND and a dimming node ADIMND. The driving current controller 170 is configured to adjust the driving current control signal DICS based on the source voltage Vsrc of the source voltage node SVND and the dimming signal of the dimming node ADIMND.

The driving current controller 170 includes a mode detector 171, a power compensator 172, a switch SW and a control signal output circuit 173.

The mode detector 171 is connected to the source voltage node SVND. The mode detector 171 may receive the source voltage Vsrc, detect whether the rectified voltage Vrct is modulated or not, depending on the source voltage Vsrc, and electrically connect the power compensator 172 and the control signal output circuit 173 depending on a detection result. The mode detector 171 may enable a selection signal SEL when it is determined that the rectified voltage Vrct is not modulated. The mode detector 171 may disable the selection signal SEL when it is determined that the rectified voltage Vrct is modulated. When the selection signal SEL is enabled, the switch SW is turned on and electrically connects the power compensator 172 to the control signal output circuit 173. When the selection signal SEL is disabled, the switch SW is turned off.

When the rectified voltage Vrct is modulated, the source voltage Vsrc may have a high variation rate. The mode detector 171 may detect whether the rectified voltage Vrct is modulated or not, depending on the variation rate of the source voltage Vsrc. For example, the mode detector 171 may include a differentiator circuit.

The power compensator 172 is connected between the source voltage node SVND and the switch SW. The power compensator 172 supplies a control current CI based on the source voltage Vsrc when the switch SW is turned on, such that the control signal output circuit 173 adjusts the driving current control signal DICS. That is to say, the power compensator 172 may control the voltage of the driving current setting node DISND by adjusting the driving current control signal DICS depending on the source voltage Vsrc. Due to this fact, even if the peak or amplitude of the source voltage Vsrc is unstable, the power compensator 172 may cause the light-emitting diode groups LED1 and LED2 to consume relatively constant power.

The control signal output circuit 173 is connected to the dimming node ADIMND. The control signal output circuit 173 may output the driving current control signal DICS depending on the dimming signal received through the dimming node ADIMND. The dimming signal may indicate the degree of modulation of the rectified voltage Vrct. The driving current control signal DICS may have a DC voltage.

In an embodiment, the dimming signal may be a DC voltage indicative of a dimming level. In another embodiment, the dimming signal may be a pulse width modulated signal indicative of a dimming level. In this case, the control signal output circuit 173 may include a component such as an integrator circuit for converting a pulse width into a voltage level.

In an embodiment, the dimming signal may be provided by the dimmer 115. In another embodiment, the lighting apparatus 100 may further include a dimming level detector which is configured to convert the rectified voltage Vrct or the source voltage Vsrc into a dimming signal. For example, the dimming level detector may be an RC integrator circuit.

The dimming signal may be received when the rectified voltage Vrct is modulated. For example, the modulated rectified voltage Vrct may be provided by using the dimmer 115, and the dimming signal may be provided from the dimmer 115 through the dimming node ADIMND. When the dimming signal is not received, the dimming node ADIMND may be floated. When the dimming signal is received through the dimming node ADIMND, the control signal output circuit 173 may set the driving current control signal DICS to have a default voltage and may adjust the voltage of the driving current control signal DICS from the default voltage.

The control signal output circuit 173 is configured to adjust the driving current control signal DICS depending on the control current CI when the control current CI is received from the power compensator 172. Because the mode detector 171 electrically connects the control signal output circuit 173 to the power compensator 172 by detecting whether the rectified voltage Vrct is modulated or not, the control current CI may be provided when the dimming signal is not provided. Conversely, when the dimming signal is provided, the control current CI may not be supplied to the control signal output circuit 173.

The power compensator 172 may output the control current CI such that the voltage of the driving current setting node DISND is decreased (in the illustrated embodiment, the voltage of the driving current control signal DICS is also decreased) as the source voltage Vsrc is large. In an embodiment, the power compensator 172 may output the control current CI by detecting the peak value of the source voltage Vsrc. In another embodiment, the power compensator 172 may output the control current CI by detecting the average value of the source voltage Vsrc.

It is to be understood that the relationship between the level of the control current CI and the voltage level of the driving current control signal DICS may be changed depending on the internal components of the control signal output circuit 173. For example, the control signal output circuit 173 may be configured in such a manner that the voltage level of the driving current control signal DICS decreases as the level of the control current CI increases. As another example, the control signal output circuit 173 may be configured in such a manner that the voltage level of the driving current control signal DICS decreases as the level of the control current CI decreases.

In this way, the driving current controller 170 in accordance with one embodiment of the invention receives the source voltage Vsrc depending on the rectified voltage Vrct, and determines whether the rectified voltage Vrct is modulated or not, depending on the source voltage Vsrc. In the case where it is determined that the rectified voltage Vrct is modulated (that is, a dimming function is to be used), the driving current controller 170 operates in a dimming mode. The driving current controller 170 adjusts the voltage of the driving current setting node DISND depending on the dimming signal. In the case where it is determined that the rectified voltage Vrct is not modulated (that is, a dimming function is not to be used), the driving current controller 170 operates in a power compensation mode. The driving current controller 170 decreases the voltage of the driving current setting node DISND as the source voltage Vsrc is large, in the power compensation mode. This means that the first and second driving currents DI1 and DI2 decrease.

The lighting apparatus 100 may adaptively cover a case where the dimming function is used and a case where the dimming function is not used automatically without use intervention, by receiving the rectified voltage Vrct and determining whether the rectified voltage Vrct is modulated or not. Further, in the case where the dimming function is not used, the lighting apparatus 100 may cause the light-emitting circuit 130 to consume relatively constant power, by decreasing the first and second driving currents DI1 and DI2 depending on whether the rectified voltage Vrct is relatively large. Due to this fact, the heat generated from the light-emitting circuit 130 may be reduced. Therefore, degradation of the first and second light-emitting diode groups LED1 and LED2 may be prevented or reduced at least.

The DC power source 180 is connected between the first power node VPND and the second power node VNND, and is configured to generate a DC voltage VCC by using the rectified voltage Vrct. In an embodiment, the DC power source 180 may be a band gap reference circuit. The DC voltage VCC may be provided as the operating voltage of the LED driver 140, the driving current setting circuit 150 and the driving current controller 170.

Figure 4:
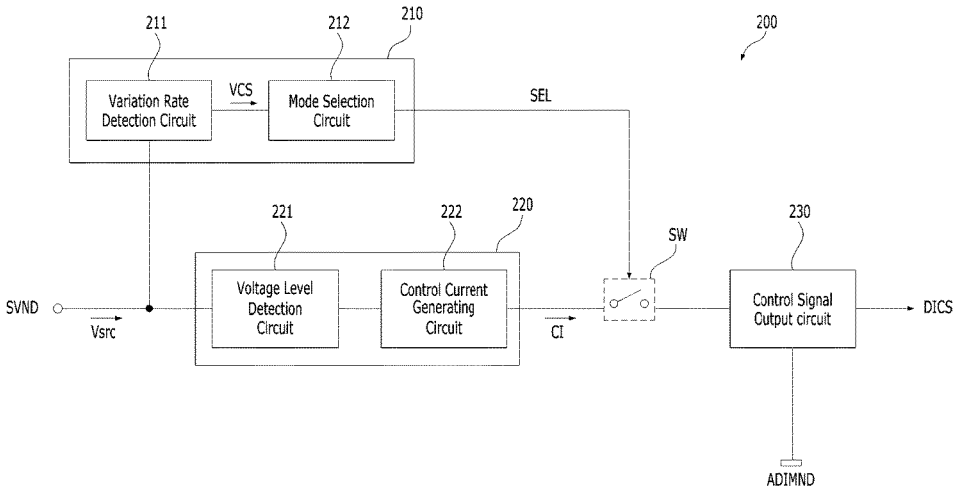
FIG. 4 is a block diagram illustrating an embodiment of the driving current controller of FIG. 1.
Figure 5A:
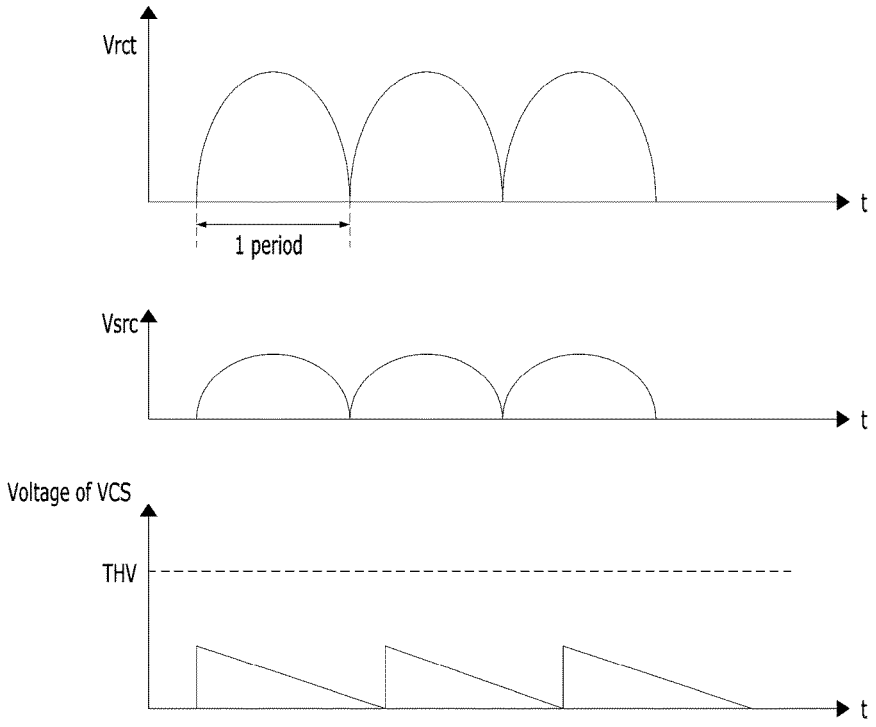
FIG. 5A are graphs showing the voltage change signal of FIG. 4 when a rectified voltage is not modulated.
Figure 5B:
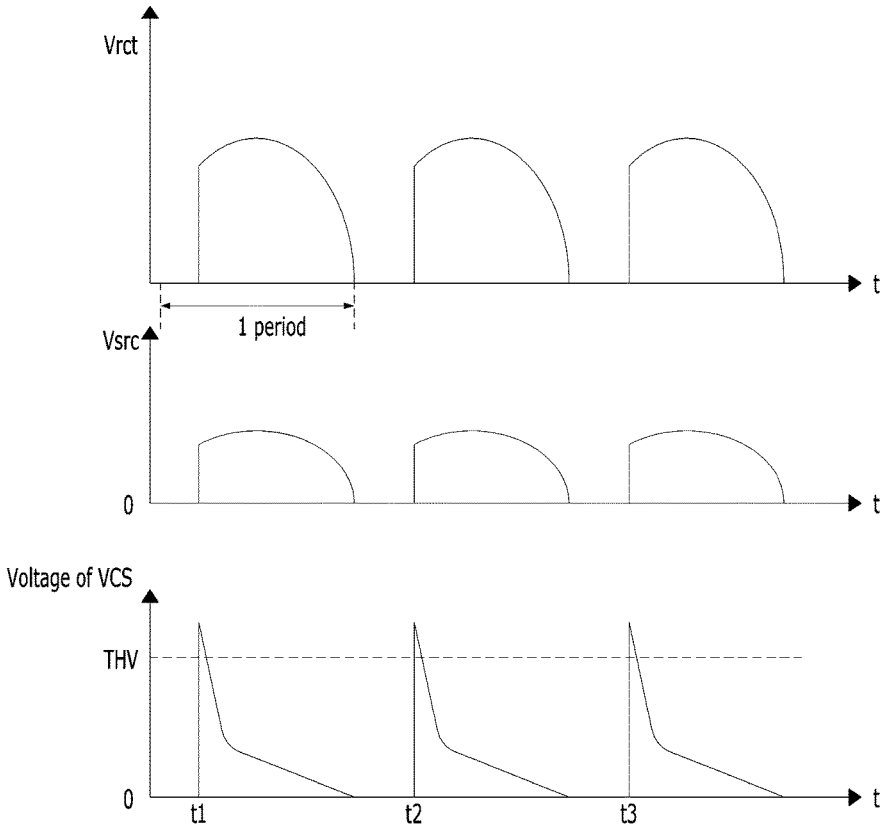
FIG. 5B are graphs showing the voltage change signal of FIG. 4 when a rectified voltage is modulated.

FIG. 4 is a block diagram illustrating an embodiment 200 of the driving current controller 170 of FIG. 1. FIG. 5A are graphs showing the voltage change signal VCS of FIG. 4 when the rectified voltage Vrct is not modulated. FIG. 5B are graphs showing the voltage change signal VCS of FIG. 4 when the rectified voltage Vrct is modulated. In FIGS. 5A and 5B, the horizontal axis represents time and the vertical axis represents voltage.

First, referring to FIG. 4, a driving current controller 200 may include a mode detector 210, a power compensator 220, a switch SW and a control signal output circuit 230.

The mode detector 210 includes a variation rate detection circuit 211 and a mode selection circuit 212.

The variation rate detection circuit 211 may output a voltage change signal VCS by detecting the variation rate of the source voltage Vsrc received through the source voltage node SVND. In an embodiment, the variation rate detection circuit 211 may be a differentiator circuit.

The mode selection circuit 212 is configured to enable the selection signal SEL depending on the voltage change signal VCS. The mode selection circuit 212 may disable the selection signal SEL when the voltage level of the voltage change signal VCS is lower than a threshold value, and may enable the selection signal SEL when the voltage level of the voltage change signal VCS is higher than or equal to the threshold value.

Referring to FIG. 5A, three periods of the rectified voltage Vrct are shown. The rectified voltage Vrct is divided to provide the source voltage Vsrc. The voltage of the voltage change signal VCS may indicate the variation rate of the source voltage Vsrc. The voltage of the voltage change signal VCS is lower than a threshold value THV. Accordingly, the selection signal SEL is disabled. Referring to FIG. 5B, the rectified voltage Vrct of three periods is phase-cut. The voltage change signal VCS is outputted depending on the source voltage Vsrc being the divided voltage of the rectified voltage Vrct. At a first time t1, a second time t2 and a third time t3, the voltage of the voltage change signal VCS is higher than the threshold value THV due to the modulation of the rectified voltage Vrct. Accordingly, the selection signal SEL is enabled. According to this scheme, whether the rectified voltage Vrct is modulated or not may be determined.

Referring again to FIG. 4, the power compensator 220 may include a voltage level detection circuit 221 and a control current generation circuit 222.

The voltage level detection circuit 221 may detect the peak value of the source voltage Vsrc received through the source voltage node SVND, and may output a detection result to the control current generation circuit 222. The voltage level detection circuit 221 may detect the peak or amplitude of the source voltage Vsrc.

The control current generation circuit 222 generates the control current CI depending on the detection result of the voltage level detection circuit 221. It is assumed that the control signal output circuit 230 is configured in such a manner that the voltage of the driving current control signal DICS decreases as the level of the control current CI is high. As the peak value of the source voltage Vsrc is high, the control current generation circuit 222 may decrease the voltage of the driving current control signal DICS by increasing the level of the control current CI. This may mean that the levels of the driving currents DI1 and DI2 of FIG. 1 decrease. As the peak value of the source voltage Vsrc is low, the control current generation circuit 222 may increase the voltage of the driving current control signal DICS by decreasing the level of the control current CI. This may mean that the levels of the driving currents DI1 and DI2 of FIG. 1 increase. Alternatively, in another embodiment, where the control signal output circuit 230 increases the voltage of the driving current control signal DICS as the level of the control current CI increases, the control current generation circuit 222 may decrease the level of the control current CI as the peak value of the source voltage Vsrc increases.

Figure 6:
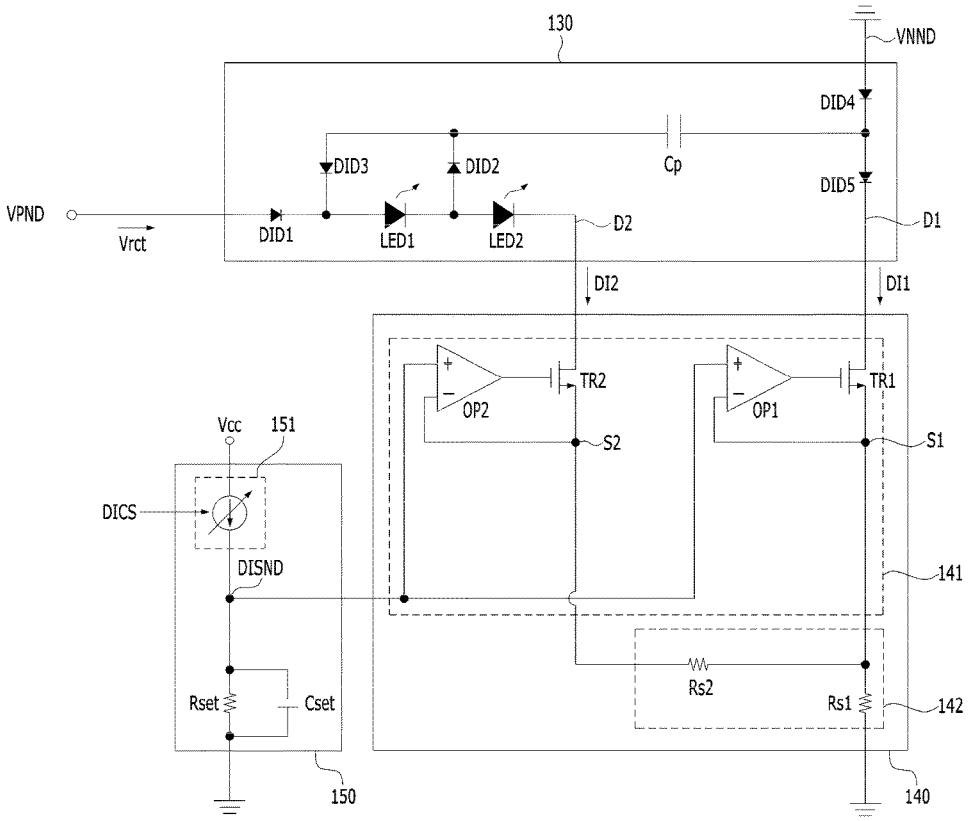
FIG. 6 is a circuit diagram illustrating embodiments of the light-emitting circuit, the LED driver and the driving current setting circuit of FIG. 1.

FIG. 6 is a circuit diagram illustrating embodiments of the light-emitting circuit 130, the LED driver 140 and the driving current setting circuit 150 of FIG. 1.

Referring to FIG. 6, the LED driver 140 may include an LED driving circuit 141 which is connected to the light-emitting circuit 130 through the first and second driving nodes D1 and D2 and is connected to the driving current setting circuit 150 through the driving current setting node DISND, and a resistor circuit 142 which is connected to the LED driving circuit 141 through first and second source nodes S1 and S2.

The LED driving circuit 141 may include a first transistor TR1 and a first comparator OP1 for controlling the first driving node D1, and a second transistor TR2 and a second comparator OP2 for controlling the second driving node D2.

The first transistor TR1 is connected between the first driving node D1 and the first source node S1. The first comparator OP1 has an output terminal which is connected to the gate of the first transistor TR1 and an inverting terminal which is connected to the first source node S1. The second transistor TR2 is connected between the second driving node D2 and the second source node S2. The second comparator OP2 has an output terminal which is connected to the gate of the second transistor TR2 and an inverting terminal which is connected to the second source node S2. The non-inverting terminals of the first and second comparators OP1 and OP2 may be connected in common to the driving current setting node DISND. The first and second transistors TR1 and TR2 may be NMOS transistors.

When the voltage of the first source node S1 is lower than the voltage of the driving current setting node DISND, the first transistor TR1 may be turned on by the output of the first comparator OP1. When the voltage of the first source node S1 becomes higher than the voltage of the driving current setting node DISND by the rectified voltage Vrct, the first transistor TR1 may be turned off by the output of the first comparator OP1. In this manner, the first transistor TR1 may be repeatedly turned on and off. Due to this fact, the voltage of the driving current setting node DISND may be reflected on the voltage of the first source node S1. Similarly, the voltage of the driving current setting node DISND may be reflected on the voltage of the second source node S2.

A first source resistor Rs1 is connected between the first source node S1 and the ground node. Therefore, depending on the voltage of the first source node S1 and the first source resistor Rs1, the level of the first driving current DI1 may be determined. A second source resistor Rs2 is connected between the second source node S2 and the first source node S1. Therefore, depending on the voltage of the second source node S2 and the sum of the first and second source resistors Rs1 and Rs2, the level of the second driving current DI2 may be determined. For example, the level of the second driving current DI2 may be lower than the level of the first driving current DI1.

In this way, the levels of the first and second driving currents DI1 and DI2 may be respectively controlled depending on the voltage of the driving current setting node DISND.

The driving current setting circuit 150 may include a voltage adjuster 151 and a setting resistor Rset.

The setting resistor Rset is connected between the driving current setting node DISND and the ground node. In order to eliminate the voltage noise of the driving current setting node DISND, a setting capacitor Cset which is connected in parallel with the setting resistor Rset may be additionally provided.

The voltage adjuster 151 applies a voltage to the driving current setting node DISND depending on the driving current control signal DICS. The voltage adjuster 151 may include a variable current source which generates a current varying depending on the driving current control signal DICS.

Figure 7:
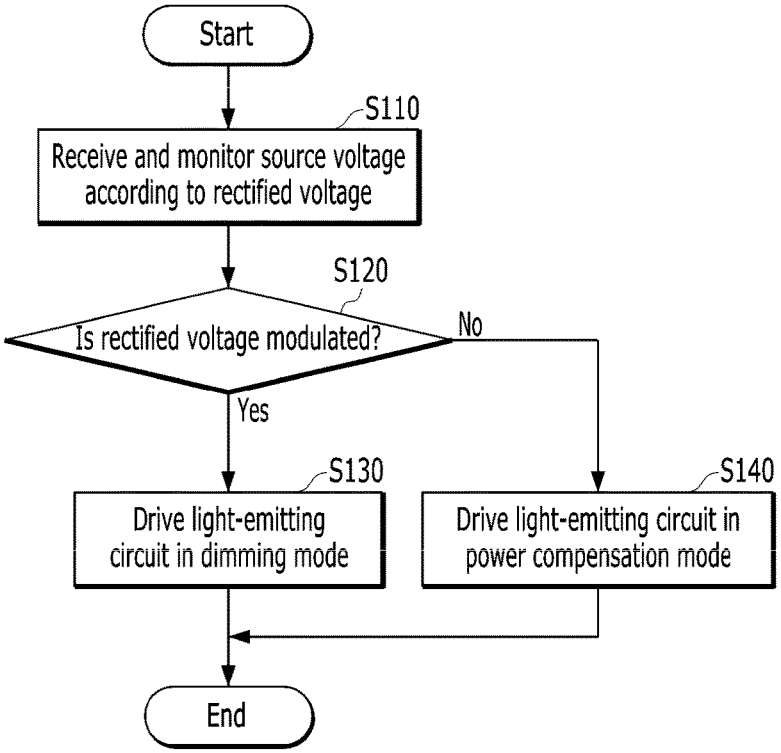
FIG. 7 is an example of a flow chart to assist in the explanation of a method for driving light-emitting diodes in accordance with an embodiment of the invention.
Figure 8:
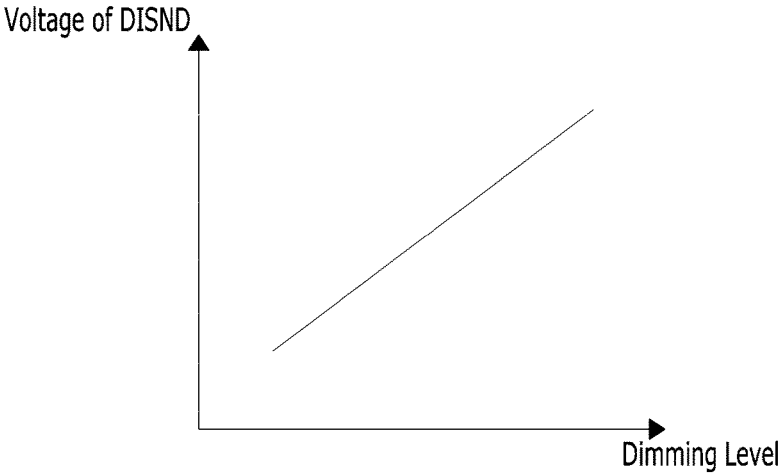
FIGS. 8 and 9 are graphs showing the relationship between a dimming level and a voltage of a driving current setting node when driving the light-emitting circuit in a dimming mode.
Figure 9:
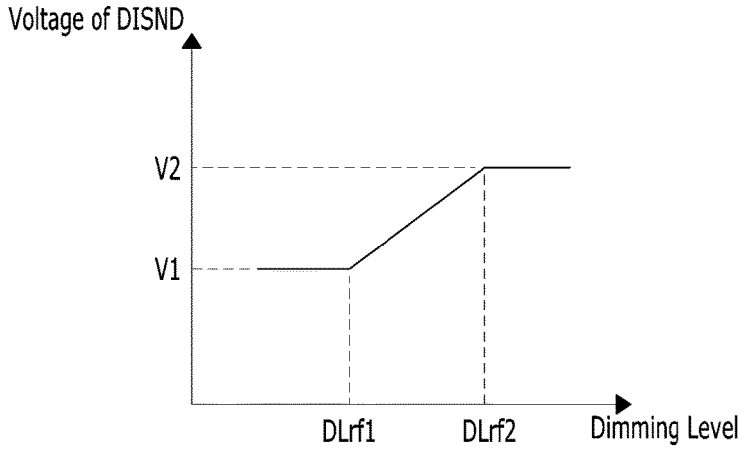
Figure 10:
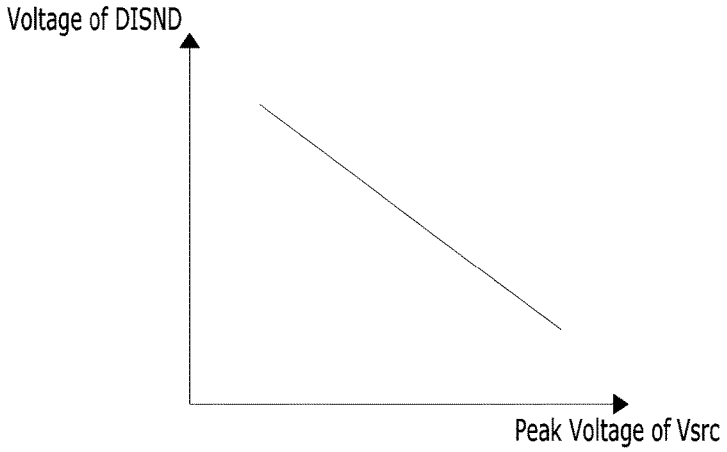
FIGS. 10 and 11 are graphs showing the relationship between the peak value of a rectified voltage and the voltage of the driving current setting node when driving the light-emitting circuit in a power compensation mode.
Figure 11:
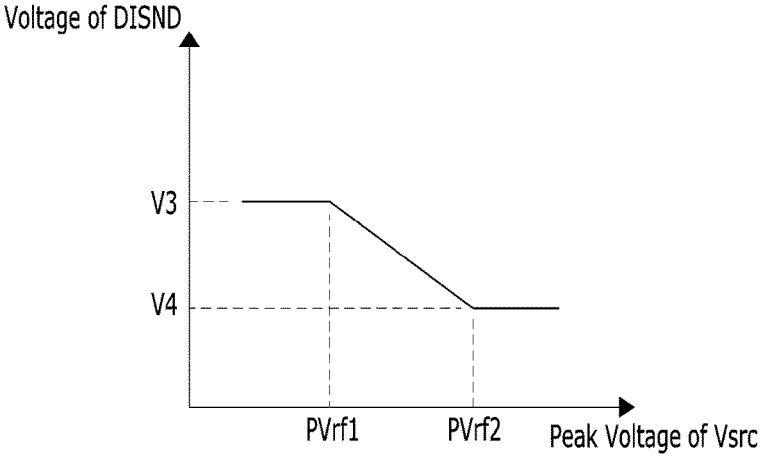

FIG. 7 is an example of a flow chart to assist in the explanation of a method for driving light-emitting diodes in accordance with an embodiment of the invention. FIGS. 8 and 9 are graphs showing the relationship between a dimming level and the voltage of the driving current setting node DISND when driving the light-emitting circuit 130 in the dimming mode. FIGS. 10 and 11 are graphs showing the relationship between the peak value of the rectified voltage Vrct and the voltage of the driving current setting node DISND when driving the light-emitting circuit 130 in the power compensation mode.

Referring to FIGS. 1 and 7, at step S110, the source voltage Vsrc depending on the rectified voltage Vrct is received and monitored. According to the illustrated embodiment, the variation rate of the source voltage Vsrc may be detected.

In another embodiment, the rectified voltage Vrct may be monitored.

At step S120, whether the rectified voltage Vrct is modulated or not is determined depending on a monitoring result of the step S110. When the variation rate of the rectified voltage Vrct is higher than a threshold value, the rectified voltage Vrct may be determined as a modulated voltage. When the variation rate of the rectified voltage Vrct is lower than or equal to the threshold value, the rectified voltage Vrct may be determined as an unmodulated voltage. When the rectified voltage Vrct is modulated, step S130 is performed. When the rectified voltage Vrct is not modulated, step S140 is performed.

At the step S130, the light-emitting circuit 130 is driven in the dimming mode. At this time, a dimming signal which indicates the degree of modulation of the rectified voltage Vrct is received. Without adjusting the currents of the driving nodes D1 and D2 depending on the source voltage Vsrc, the currents of the driving nodes D1 and D2 are adjusted depending on the dimming signal.

In an embodiment, as shown in FIG. 8, as a dimming level increases, the voltage of the driving current setting node DISND may be increased. In another embodiment, as shown in FIG. 9, the voltage of the driving current setting node DISND may be controlled to a first voltage V1 when a dimming level is lower than a first reference dimming level DLrf1, may be controlled to a second voltage V2 higher than the first voltage V1 when a dimming level is higher than a second reference dimming level DLrf2, and may be increased depending on a dimming level between the first and second voltages V1 and V2 when a dimming level is between the first and second reference dimming levels DLrf1 and DLrf2.

Referring again to FIGS. 1 and 7, at the step S140, the light-emitting circuit 130 is driven in the power compensation mode. At this time, a dimming signal is not received. For example, the dimming node ADIMND may be floated. In this case, the currents of the driving nodes D1 and D2 are adjusted depending on the source voltage Vsrc.

In an embodiment, as shown in FIG. 10, as the peak value of the source voltage Vsrc increases, the voltage of the driving current setting node DISND may be decreased. In another embodiment, as shown in FIG. 11, the voltage of the driving current setting node DISND may be controlled to a third voltage V3 when a peak value is lower than a first reference peak value PVrf1, may be controlled to a fourth voltage V4 lower than the third voltage V3 when a peak value is higher than a second reference peak value PVrf2, and may be decreased depending on a peak value between the third and fourth voltages V3 and V4 when the peak value is between the first and second reference peak values PVrf1 and PVrf2.

According to one embodiment of the invention, by determining whether the rectified voltage Vrct is modulated or not, it is possible to adaptively cover a case where the dimming function is used and a case where the dimming function is not used. Further, in the case where the dimming function is not used, as the light-emitting circuit 130 is driven in the power compensation mode, it is possible to cause the light-emitting circuit 130 to consume relatively constant power.

Figure 12:
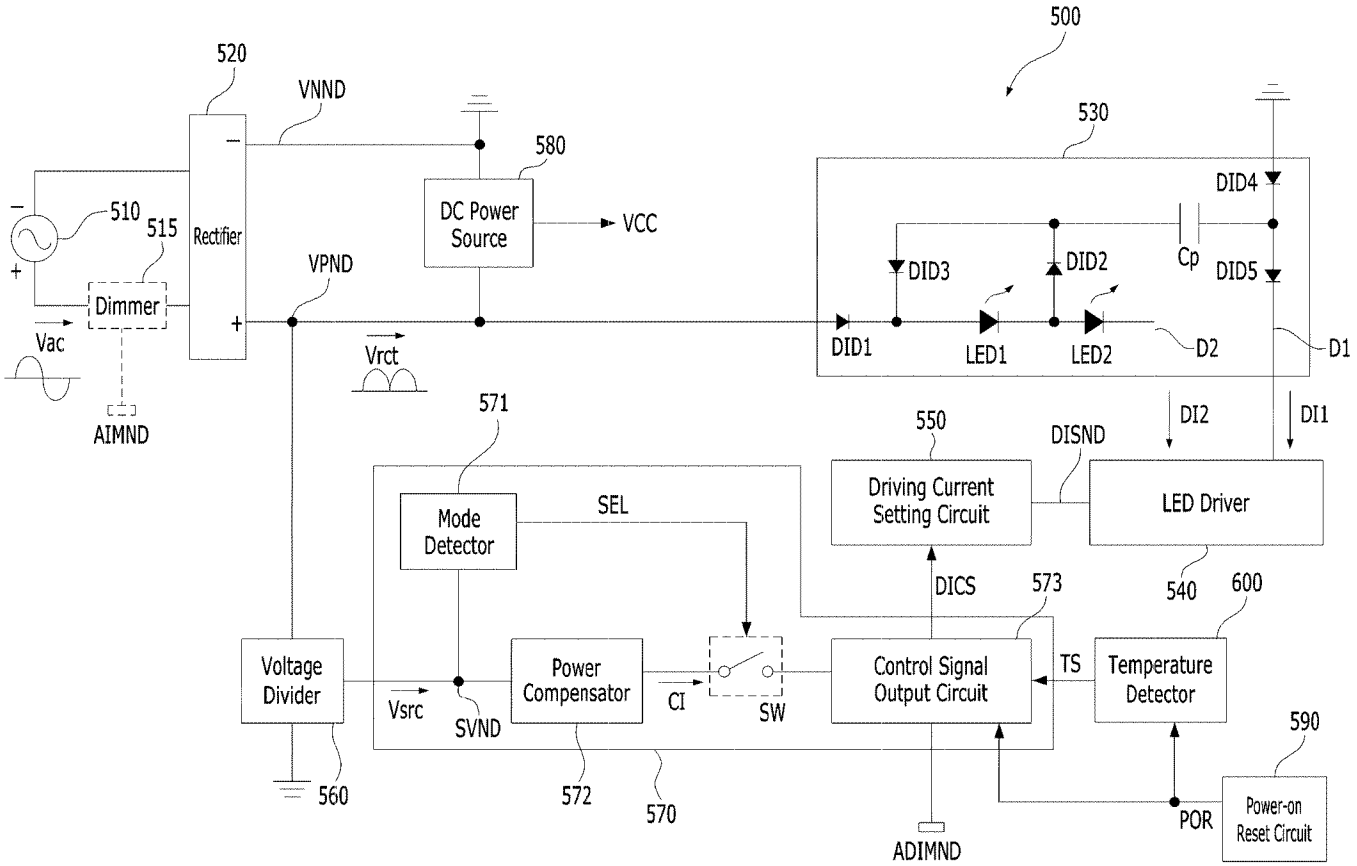
FIG. 12 is a block diagram illustrating a lighting apparatus constructed in accordance with an exemplary embodiment of the invention.

FIG. 12 is a block diagram illustrating a lighting apparatus constructed in accordance with an exemplary embodiment of the invention.

The lighting apparatus 500 includes a rectifier 520, a light-emitting circuit 530, an LED driver 540, a driving current setting circuit 550, a voltage divider 560, a driving current controller 570, a DC power source 580, a power-on reset circuit 590 and a temperature detector 600.

The rectifier 520, the light-emitting circuit 530, the LED driver 540, the driving current setting circuit 550, the voltage divider 560 and the DC power source 580 are configured in a manner similar to the rectifier 120, the light-emitting circuit 130, the LED driver 140, the driving current setting circuit 150, the voltage divider 160 and the DC power source 180, respectively, described above with reference to FIG. 1. Hereinbelow, duplicate descriptions will be omitted.

The driving current controller 570 includes a mode detector 571, a power compensator 572, a switch SW and a control signal output circuit 573. The mode detector 571, the power compensator 572 and the switch SW are configured in a manner similar to the mode detector 171, the power compensator 172 and the switch SW, respectively, described above with reference to FIG. 1. The control signal output circuit 573 may additionally receive a temperature detection signal TS when compared to the control signal output circuit 173 of FIG. 1.

The power-on reset circuit 590 is configured to detect the rectified voltage Vrct and/or the DC voltage VCC and generate a power-on reset signal POR. For example, the power-on reset circuit 590 may enable the power-on reset signal POR after a certain time elapses from when the rectified voltage Vrct begins to be applied.

The temperature detector 600 is configured to detect a temperature in response to the power-on reset signal POR. The temperature detector 600 may output the temperature detection signal TS when a current temperature is higher than a temperature limit.

The control signal output circuit 573 controls the driving current control signal DICS depending on the temperature detection signal TS. According to one embodiment of the invention, the control signal output circuit 573 may output a predetermined voltage as the driving current control signal DICS in response to the temperature detection signal TS. Such a predetermined voltage controls the driving currents DI1 and DI2 to be set and fixed to predetermined fixed levels. For example, the predetermined voltage may be selected such that the light-emitting diode groups LED1 and LED2 emit halves of predetermined maximum light amounts.

The control signal output circuit 573 may retain the driving current control signal DICS at the predetermined voltage until power (for example, the AC voltage Vac and/or the rectified voltage Vrct) is turned off. In an embodiment, the control signal output circuit 573 may receive the power-on reset signal POR as shown in FIG. 12. In this case, the control signal output circuit 573 may fix the driving current control signal DICS to the predetermined voltage unless the power-on reset signal POR is disabled. Therefore, until power is turned off, the light-emitting diode groups LED1 and LED2 may emit fixed amounts of light.

Figure 13:
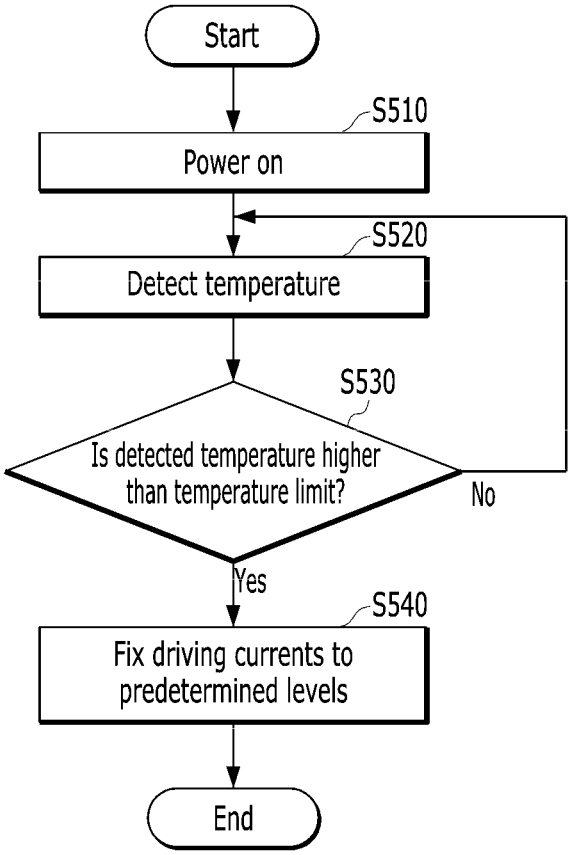
FIG. 13 is an example of a flow chart to assist in the explanation of a method for driving light-emitting diodes in accordance with an embodiment of the invention.

FIG. 13 is an example of a flow chart to assist in the explanation of a method for driving light-emitting diodes in accordance with an embodiment of the invention.

Referring to FIGS. 12 and 13, at step S510, power begins to be applied, and the power-on reset signal POR is generated.

At step S520, after the power-on reset signal POR is generated, a current temperature is detected. At step S530, whether a detected temperature is higher than the temperature limit is determined. If so, step S540 is performed.

At the step S540, the driving currents DI1 and DI2 are set and fixed to the predetermined levels. Until power is turned off, the driving currents DI1 and DI2 may be fixed to the predetermined levels.

According to one embodiment of the invention, when a current temperature is higher than the temperature limit, it is possible to control the light-emitting diode groups LED1 and LED2 to emit predetermined amounts of light. According to this fact, a user may easily recognize that the lighting apparatus 500 is overheated. Meanwhile, the lighting apparatus 500 may be easily overheated when being degraded. According to the illustrated embodiment, unless power is turned off, by controlling the light-emitting diode groups LED1 and LED2 to retain fixed amounts of light, a user may easily recognize that it is necessary to replace the light-emitting diode groups LED1 and LED2, the light-emitting circuit 530 and/or the lighting apparatus 500.

Figure 14:
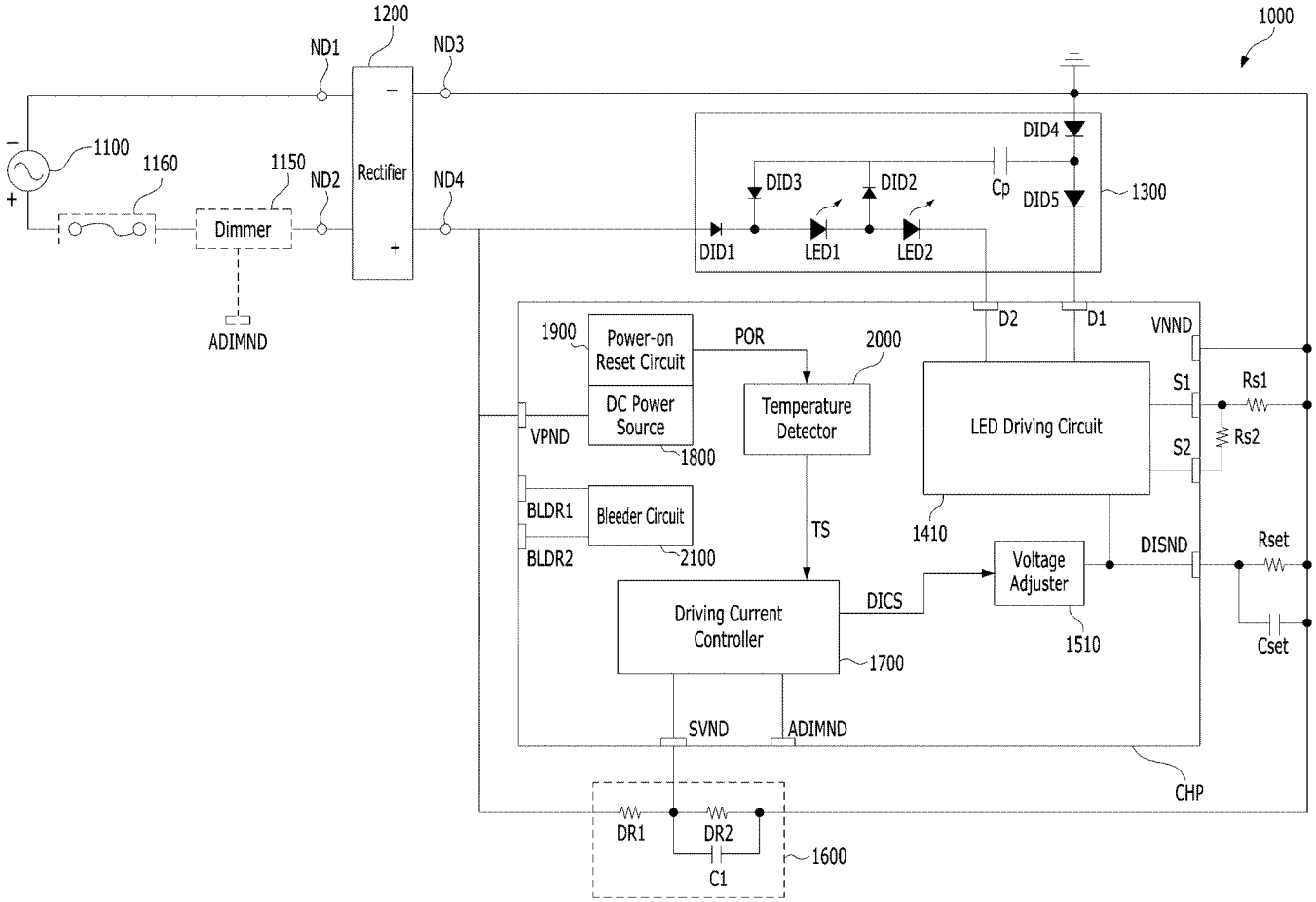
FIG. 14 is a block diagram illustrating a lighting apparatus constructed in accordance with an exemplary embodiment of the invention.

FIG. 14 is a block diagram illustrating a lighting apparatus constructed in accordance with an exemplary embodiment of the invention.

Referring to FIG. 14, the lighting apparatus 1000 is connected to an AC power source 1100. The lighting apparatus 1000 includes a rectifier 1200, a light-emitting circuit 1300, an LED driving circuit 1410, a voltage adjuster 1510, a voltage divider 1600, a driving current controller 1700, a DC power source 1800, a power-on reset circuit 1900, a temperature detector 2000, a setting resistor Rset, a setting capacitor Cset and first and second source resistors Rs1 and Rs2.

The lighting apparatus 1000 further includes a dimmer 1150 depending on a user's choice. According to the illustrated embodiment, the lighting apparatus 1000 is configured to determine whether a rectified voltage Vrct is modulated or not, based on the rectified voltage Vrct, and operate in a dimming mode or a power compensation mode depending on a determination result.

The lighting apparatus 1000 may further include a fuse 1160. The fuse 1160 may electrically block the lighting apparatus 1000 from the AC power source 1100, for example, when an undesired high voltage is applied from the AC power source 1100.

The LED driving circuit 1410, the voltage adjuster 1510, the driving current controller 1700, the DC power source 1800, the power-on reset circuit 1900 and the temperature detector 2000 may be mounted in one semiconductor chip CHP. The LED driving circuit 1410 and the voltage adjuster 1510 may be configured in a manner similar to the LED driving circuit 141 and the voltage adjuster 151, respectively, described above with reference to FIG. 6, the driving current controller 1700 and the DC power source 1800 may be configured in a manner similar to the driving current controller 170 and the DC power source 180, respectively, described above with reference to FIG. 1, and the power-on reset circuit 1900 and the temperature detector 2000 may be configured in a manner similar to the power-on reset circuit 590 and the temperature detector 600, respectively, described above with reference to FIG. 12.

The semiconductor chip CHP may further include a bleeder circuit 2100. The bleeder circuit 2100 may control a triac trigger current between first and second bleeder nodes BLDR1 and BLDR2. The bleeder circuit 2100 may be connected to appropriate nodes depending on the embodiments of the lighting apparatus 1000, the characteristics of the dimmer 1150, the position of the dimmer 1150 in the lighting apparatus 1000, etc. In an embodiment, the first and second bleeder nodes BLDR1 and BLDR2 may be connected to first and second nodes ND1 and ND2, respectively. In another embodiment, the first and second bleeder nodes BLDR1 and BLDR2 may be connected to third and fourth nodes ND3 and ND4, respectively.

The voltage divider 1600 is connected to the driving current controller 1700 through a source voltage node SVND, and may be configured in a manner similar to the voltage divider 160 described above with reference to FIGS. 1 and 3. The setting resistor Rset and the setting capacitor Cset are connected to the voltage adjuster 1510 through a driving current setting node DISND, and may be configured in a manner similar to the setting resistor Rset and the setting capacitor Cset, respectively, described above with reference to FIG. 6. The first and second source resistors Rs1 and Rs2 are connected to the LED driving circuit 1410 through first and second source nodes S1 and S2, respectively, and may be configured in a manner similar to the first and second source resistors Rs1 and Rs2, respectively, described above with reference to FIG. 6.

The voltage divider 1600, the setting resistor Rset, the setting capacitor Cset and the first and second source resistors Rs1 and Rs2 may be disposed outside the semiconductor chip CHP. In this case, the impedances of dividing resistors DR1 and DR2 and a capacitor C1 of the voltage divider 1600, the setting resistor Rset, the setting capacitor Cset and the source resistors Rs1 and Rs2 may be selected appropriately depending on a user's requirement.

Figure 15:
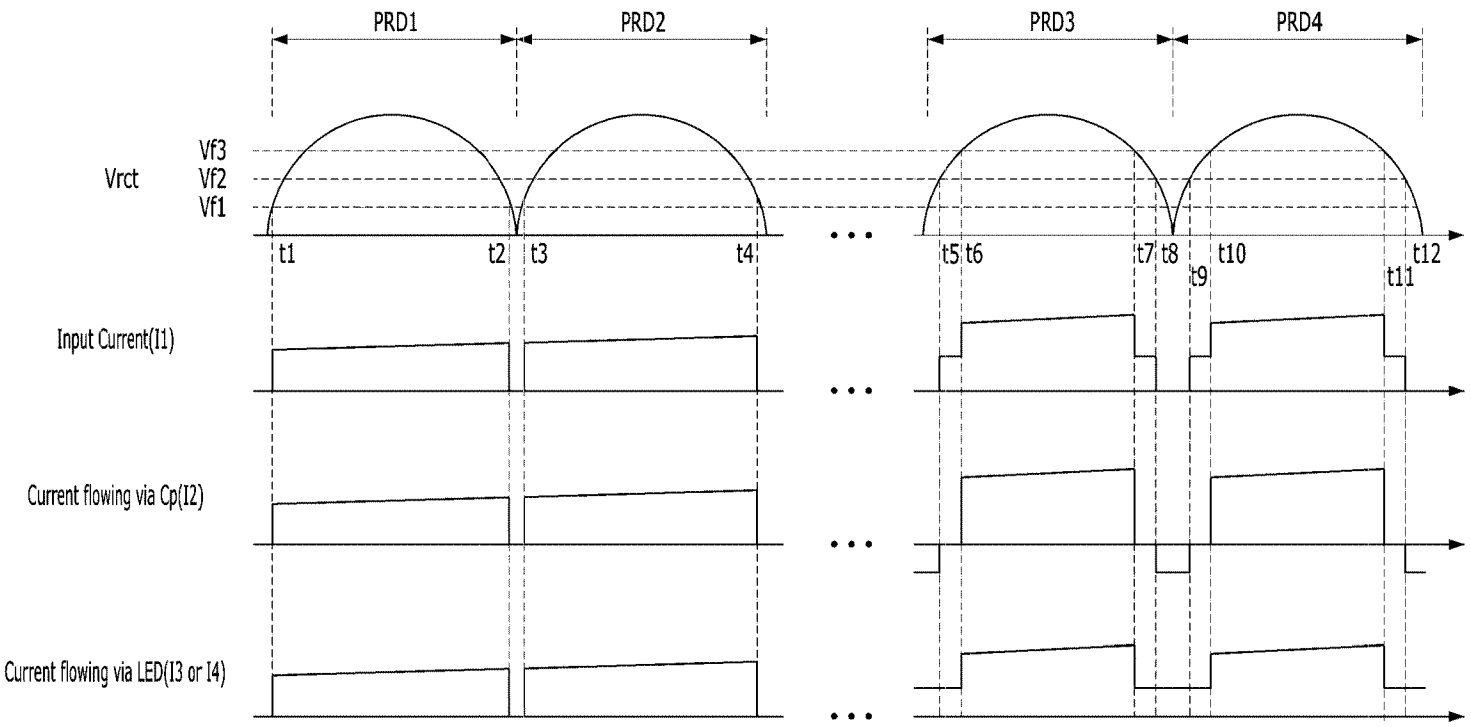
FIG. 15 is an exemplary timing diagram to assist in the explanation of a method for operating light-emitting diodes in accordance with an embodiment of the invention.
Figure 16:
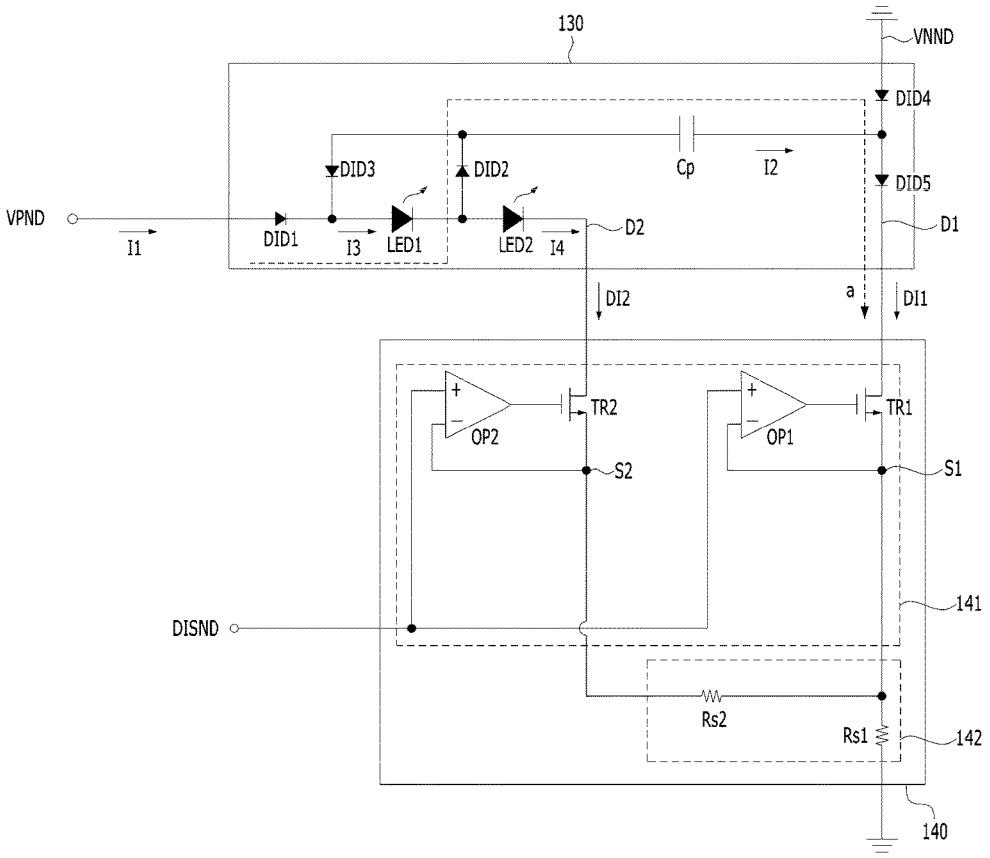
FIGS. 16 to 18 are exemplary diagrams to assist in the explanation of how current flows through an embodiment of a light-emitting circuit during first to third driving stages.
Figure 17:
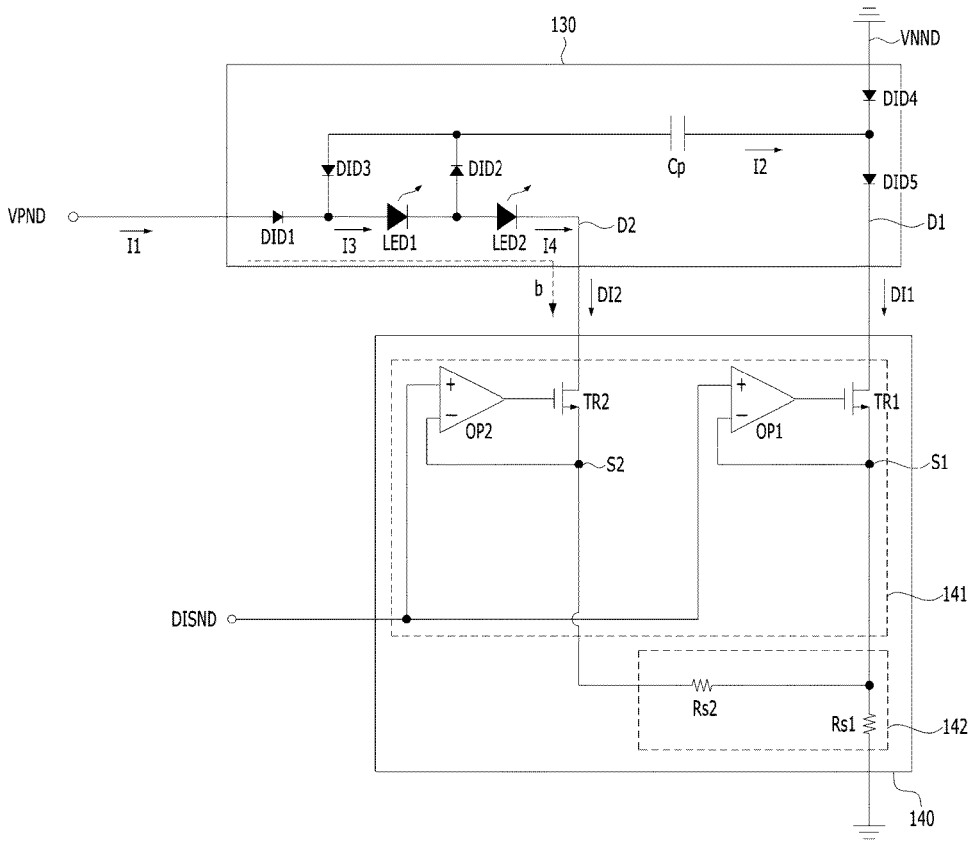
Figure 18:
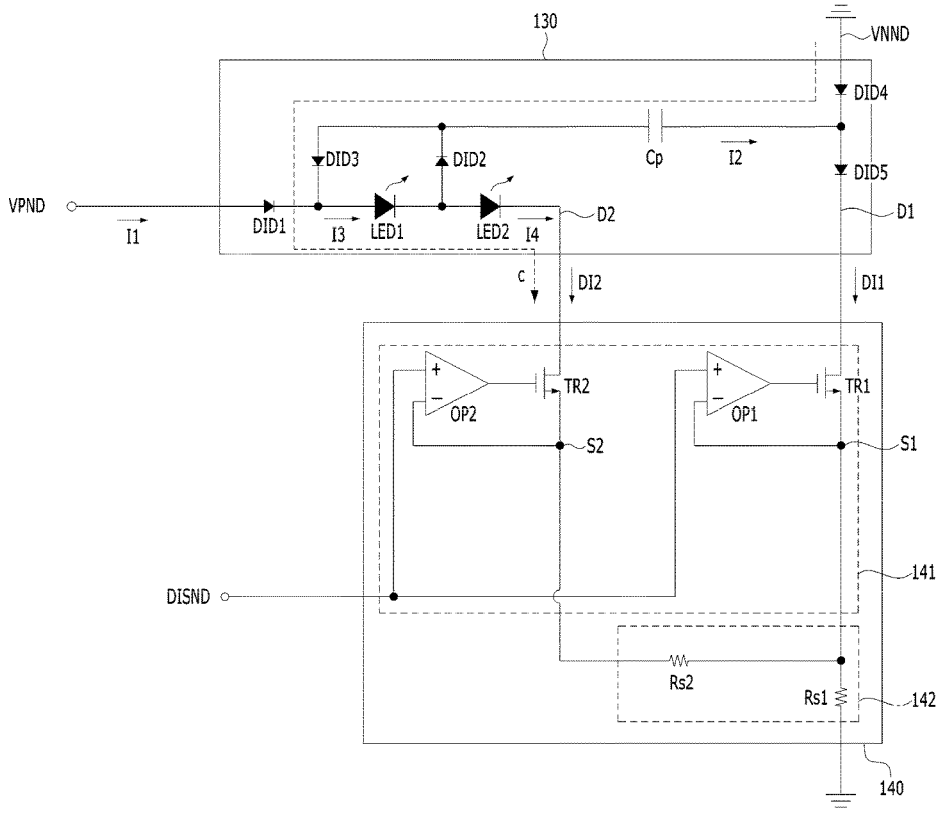

FIG. 15 is an exemplary timing diagram to assist in the explanation of a method for operating light-emitting diodes in accordance with an embodiment of the invention. FIGS. 16 to 18 are exemplary diagrams to assist in the explanation of how current flowing through an embodiment of a light-emitting circuit during first to third driving stages. In FIGS. 16 to 18, for the sake of convenience in explanation, only the light-emitting circuit 130 and the LED driver 140 of FIG. 6 are shown.

Referring to FIGS. 15 to 18, the rectified voltage Vrct is received. While the rectified voltage Vrct which is not modulated is shown in FIG. 15, embodiments of the invention is not limited thereto. It is apparent that embodiments of the invention may be similarly applied to the rectified voltage Vrct which is modulated, within a range obtainable from the following description. Hereinafter, it is assumed for the sake of convenience in explanation that the rectified voltage Vrct which is not modulated is received.

At a first time t1, the rectified voltage Vrct of a first period PRD1 increases and reaches a first voltage Vf1. The first voltage Vf1 may be the forward voltage of the first light-emitting diode group LED1. Meanwhile, when the rectified voltage Vrct begins to be applied, the capacitor Cp is not charged with charges. For example, in an initial operation, the voltage of both ends of the capacitor Cp may be 0V. In this case, as in a current path 'a' shown in FIG. 16, a current I1 inputted to the light-emitting circuit 130 may flow through the first light-emitting diode group LED1, the capacitor Cp and the first driving node D1. The first light-emitting diode group LED1 emits light by a current I3 which flows through the first light-emitting diode group LED1. The capacitor Cp is charged by a current I2 which flows through the capacitor Cp. When the capacitor Cp is charged, the current and voltage of both ends of the capacitor Cp may increase gradually. The operation of causing the first light-emitting diode group LED1 to emit light and charging the capacitor Cp by using the input current I1 may be defined as a first driving stage.

At a second time t2, the rectified voltage Vrct of the first period PRD1 may become lower than the sum of the forward voltage of the first light-emitting diode group LED1 and the voltage of both ends of the capacitor Cp. As the current path 'a' of FIG. 16 is blocked, the first driving stage may be stopped. At this time, the sum of the forward voltage of the first light-emitting diode group LED1 and the voltage of both ends of the capacitor Cp may be between the first voltage Vf1 and a second voltage Vf2 as shown in FIG. 15. The second voltage Vf2 may be the sum of the forward voltages of the first and second light-emitting diode groups LED1 and LED2.

At a third time t3, the rectified voltage Vrct of a second period PRD2 may become higher than the sum of the forward voltage of the first light-emitting diode group LED1 and the voltage of both ends of the capacitor Cp. As the input current I1 flows through the current path 'a' of FIG. 16, the first driving stage may be performed. The first light-emitting diode group LED1 emits light, and the capacitor Cp is charged.

At a fourth time t4, the rectified voltage Vrct of the second period PRD2 may become lower than the sum of the forward voltage of the first light-emitting diode group LED1 and the voltage of both ends of the capacitor Cp. As the current path 'a' of FIG. 16 is blocked, the first driving stage may be stopped.

In this way, by using the rectified voltage Vrct of a plurality of periods, the first driving stage may operate, and the capacitor Cp may be charged. While the rectified voltage Vrct of the plurality of periods is received, the voltage of both ends of the capacitor Cp may become higher than the second voltage Vf2 and a third voltage Vf3. The third voltage Vf3 may be the sum of the voltage of both ends of the capacitor Cp charged by a desired amount of charges and the forward voltage of the first light-emitting diode group LED1.

At a fifth time t5, the rectified voltage Vrct of a third period PRD3 increases and reaches the second voltage Vf2. As described above, the second voltage Vf2 may be the sum of the forward voltages of the first and second light-emitting diode groups LED1 and LED2. As in a current path 'b' shown in FIG. 17, the input current I1 may flow through the first and second light-emitting diode groups LED1 and LED2 and the second driving node D2. The first light-emitting diode group LED1 may emit light by the current I3 which flows through the first light-emitting diode group LED1. The second light-emitting diode group LED2 may emit light by a current I4 which flows through the second light-emitting diode group LED2. The operation of causing the first and second light-emitting diode groups LED1 and LED2 to emit light by using the input current I1 may be defined as a second driving stage.

At a sixth time t6, the rectified voltage Vrct of the third period PRD3 becomes higher than the third voltage Vf3. As the input current I1 flows through the current path 'a' of FIG. 16, the first driving stage may be performed.

Meanwhile, the sum of the resistances of the resistors Rs1 and Rs2 which are connected to the second driving node D2 through the second transistor TR2 is higher than the resistance of the resistor Rs1 which is connected to the first driving node D1 through the first transistor TR1. The input current I1 may flow through the resistor Rs1 as in the current path 'a' of FIG. 16. Due to this fact, the current path 'b' of FIG. 17 which flows through the second driving node D2 may be gradually blocked. Therefore, the second driving stage may be stopped.

The resistance of the resistor Rs1 on the current path 'a' of FIG. 16 is lower than the resistance of the resistors Rs1 and Rs2 on the current path 'b' of FIG. 17. Due to this fact, the current flowing through the first light-emitting diode group LED1 in the second driving stage may be higher than the current flowing through the first and second light-emitting diode groups LED1 and LED2 in the first driving stage.

At a seventh time t7, the rectified voltage Vrct of the third period PRD3 becomes lower than the third voltage Vf3. As the current path 'a' of FIG. 16 is blocked, the first driving stage is stopped. Meanwhile, at the seventh time t7, the rectified voltage Vrct of the third period PRD3 is higher than the second voltage Vf2. As the input current I1 flows through the current path 'b' of FIG. 17, the second driving stage may be performed.

At an eighth time t8, the rectified voltage Vrct of the third period PRD3 further decreases and becomes lower than the second voltage Vf2. As the current path 'b' of FIG. 17 is blocked, the second driving stage may be stopped. Conversely, the voltage of both ends of the charged capacitor Cp may be higher than the second voltage Vf2. In this case, as in a current path 'c' shown in FIG. 18, the charges charged in the capacitor Cp may flow through the capacitor Cp, the first and second light-emitting diode groups LED1 and LED2 and the second driving node D2. The operation of causing the first and second light-emitting diode groups LED1 and LED2 to emit light by using the capacitor Cp may be defined as a third driving stage.

By performing the third driving stage, even through the rectified voltage Vrct is lower than the second voltage Vf2, the first and second light-emitting diode groups LED1 and LED2 may emit light. The capacity of the capacitor Cp may be selected such that the capacitor Cp may be charged to be higher than the second voltage Vf2.

A ninth time t9, a tenth time t10, an eleventh time t11 and a twelfth time t12 may be described in a manner similar to the fifth time t5, the sixth time t6, the seventh time t7 and the eighth time t8, respectively. At the ninth time t9, as the input current I1 flows through the current path 'b' of FIG. 17, the second driving stage operates. At the tenth time t10, as the input current I1 flows through the current path 'a' of FIG. 16, the first driving stage operates, and the second driving stage is stopped. At the eleventh time t11, as the input current I1 flows through the current path 'b' of FIG. 17, the second driving stage operates, and the first driving stage is stopped. At the twelfth time t12, as the charges charged in the capacitor Cp flow through the current path 'c' of FIG. 18, the third driving stage operates, and the second driving stage is stopped.

According to one embodiment of the invention, while the rectified voltage Vrct of at least one period (for example, the periods PRD1 and PRD2) is inputted, as the first driving stage operates without the second and third driving stages, the capacitor Cp may be charged. Thereafter, when the rectified voltage Vrct of periods (for example, the periods PRD3 and PRD4) is inputted, the first driving stage, the second driving stage and the third driving stage may selectively operate depending on the level of the rectified voltage Vrct.

Figure 19:
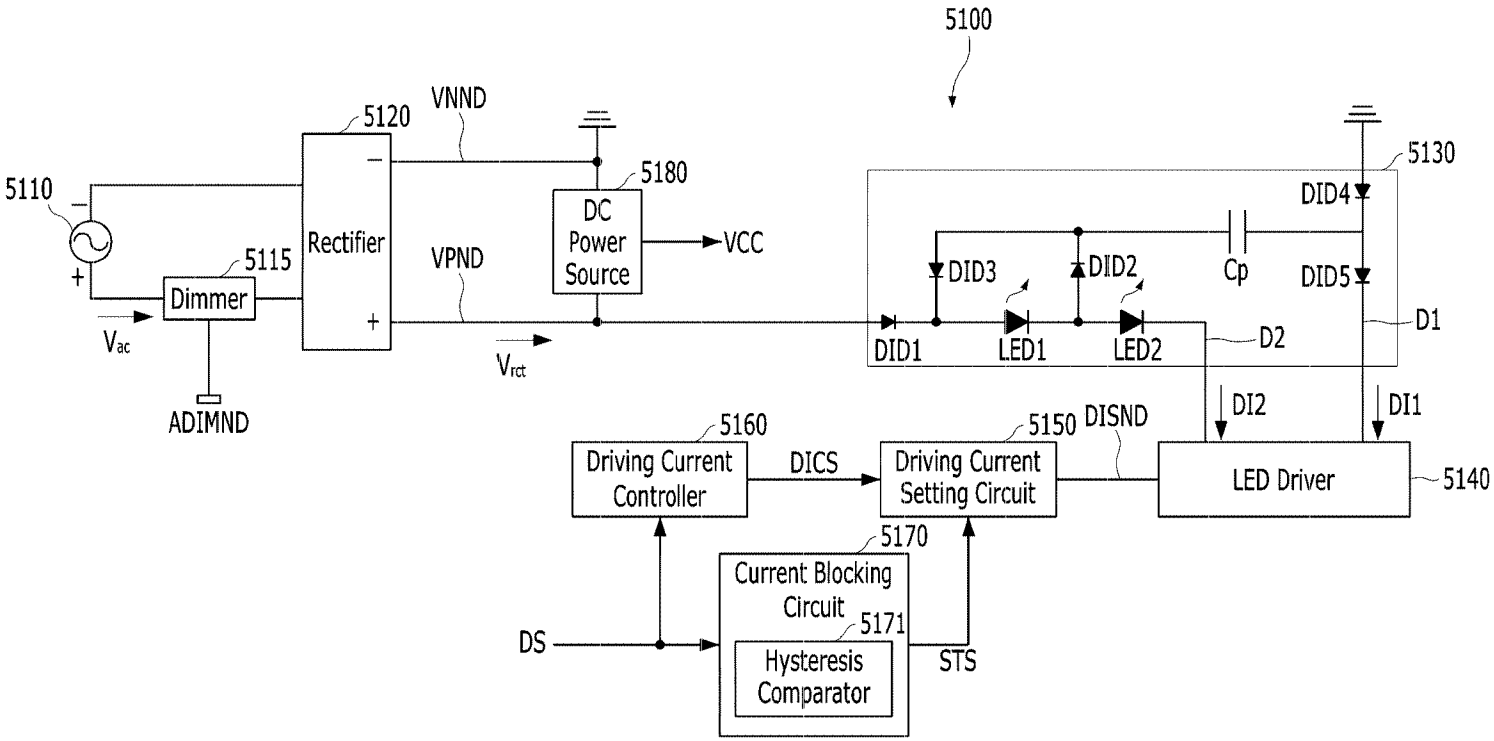
FIG. 19 is a block diagram illustrating a lighting apparatus constructed in accordance with an exemplary embodiment of the invention.

FIG. 19 is a block diagram illustrating a lighting apparatus constructed in accordance with an exemplary embodiment of the invention. FIGS. 20A, 20B, 20C and 20D are circuit diagrams illustrating exemplary embodiments of the light-emitting diode group of FIG. 19.

Referring to FIG. 19, the lighting apparatus 5100 may be connected to an AC power source 5110 and receive an AC voltage Vac, and may include a dimmer 5115, a rectifier 5120, a light-emitting circuit 5130, an LED driver 5140, a driving current setting circuit 5150, a driving current controller 5160, a current blocking circuit 5170 and a DC power source 5180.

The dimmer 5115 may receive the AC voltage Vac from the AC power source 5110, modulate the AC voltage Vac according to a user's control (or selection) for the dimming of the light-emitting circuit 5130, and output a modulated AC voltage.

In an embodiment, the dimmer 5115 may be implemented as a triac dimmer, which cuts the phase of the AC voltage Vac by using a triac, a pulse width dimmer which modulates the pulse width of the AC voltage Vac or other dimmers know in the art.

In the embodiment where the dimmer 5115 is a triac dimmer, the dimmer 5115 may output a modulated AC voltage by cutting the phase of the AC voltage Vac according to a user's control. At this time, control over a triac trigger current may be required. To this end, the lighting apparatus 5100 may further include a bleeder circuit which is connected between the dimmer 5115 and the rectifier 5120. The bleeder circuit may include, for example, a bleeder capacitor and a bleeder resistor In FIG. 19, it is illustrated that the dimmer 5115 is provided as a component of the lighting apparatus 5100. However, it is to be noted that embodiments of the invention are not limited thereto. The dimmer 5115 may be disposed outside the lighting apparatus 5100 and be electrically connected with the lighting apparatus 5100.

The rectifier 5120 is configured to rectify the AC voltage modulated by the dimmer 5115 and output a rectified voltage Vrct through a first power node VPND and a second power node VNND. The rectified voltage Vrct is outputted to the light-emitting circuit 5130.

In an embodiment, the lighting apparatus 5100 may further include a surge protection circuit which is configured to protect internal components of the lighting apparatus 5100 from an overvoltage and/or an overcurrent. The surge protection circuit may be connected, for example, between the first and second power nodes VPND and VNND.

The light-emitting circuit 5130 is connected between the first and second power nodes VPND and VNND. The light-emitting circuit 5130 receives the rectified voltage Vrct through the first and second power nodes VPND and VNND, and emits light by using the rectified voltage Vrct.

The light-emitting circuit 5130 operates according to the control of the LED driver 5140. The light-emitting circuit 5130 may include a first light-emitting diode group LED1, a second light-emitting diode group LED2 and a capacitor Cp. The first and second light-emitting diode groups LED1 and LED2 and the capacitor Cp are connected to the LED driver 5140 through driving nodes D1 and D2. While it is illustrated in FIG. 19 that the light-emitting circuit 5130 includes the two light-emitting diode groups LED1 and LED2 and the capacitor Cp, it is to be noted that embodiments of the invention are not limited thereto. The numbers of the light-emitting diode groups and capacitor included in the light-emitting circuit 5130, the connection relationship between the light-emitting diode groups and the capacitor, and the number of driving nodes which connect the light-emitting diode groups and the capacitor to the LED driver 5140 may be changed variously.

Figure 20A:
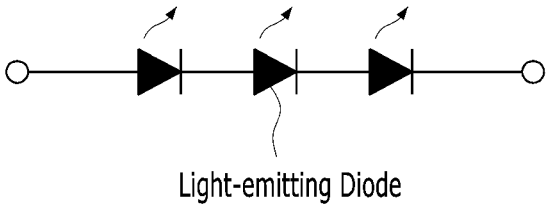
FIGS. 20A, 20B, 20C and 20D are circuit diagrams illustrating exemplary embodiments of the light-emitting diode group of FIG. 19.
Figure 20B:
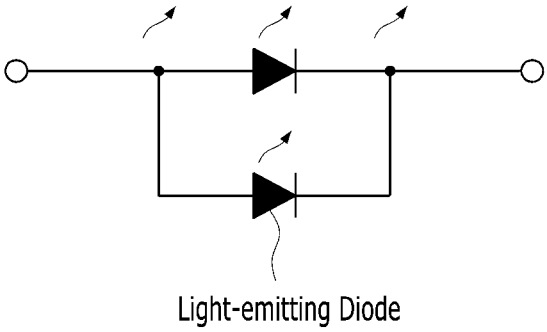
Figure 20C:
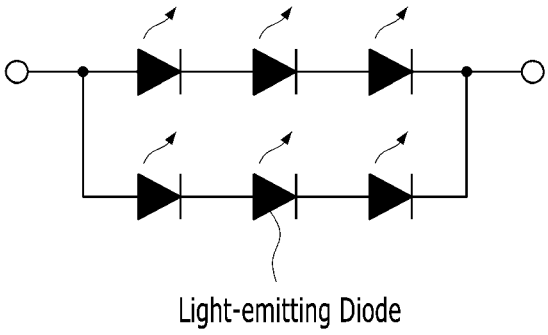
Figure 20D:
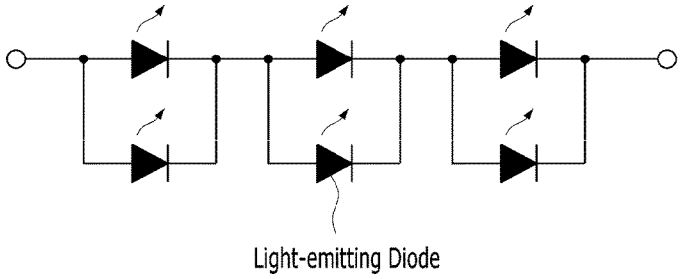

Each of the first and second light-emitting diode groups LED1 and LED2 may include one or more light-emitting diodes. The number of the light-emitting diodes included in each light-emitting diode group and the connection relationship of the light-emitting diodes may also be changed variously. Exemplary embodiments of each light-emitting diode group are shown in FIGS. 20A to 20D. Referring to FIG. 20A, each light-emitting diode group may include a plurality of light-emitting diodes which are connected in series. Referring to FIG. 20B, each light-emitting diode group may include a plurality of light-emitting diodes which are connected in parallel. Referring to FIG. 20C, each light-emitting diode group may include sub groups which are connected in parallel, and each sub group may include a plurality of light-emitting diodes which are connected in series. Referring to FIG. 20D, each light-emitting diode group may include sub groups which are connected in series, and each sub group may include a plurality of light-emitting diodes which are connected in parallel. According to these embodiments, the first light-emitting diode group LED1 and the second light-emitting diode group LED2 may have the same forward voltage or may have different forward voltages. A forward voltage is a threshold voltage capable of driving a corresponding light-emitting diode group.

Referring again to FIG. 19, the first and second light-emitting diode groups LED1 and LED2 may be connected in series between the first power node VPND and the second driving node D2. The capacitor Cp may be connected between the output terminal of the first light-emitting diode group LED1 (or the input terminal of the second light-emitting diode group LED2) and the first driving node D1. The capacitor Cp may be charged and discharged depending on the level of the rectified voltage Vrct, and may provide a current to at least one of the first and second light-emitting diode groups LED1 and LED2 when being discharged. By the presence of the capacitor Cp, the first and second light-emitting diode groups LED1 and LED2 may emit light even through the level of the rectified voltage Vrct becomes low.

In an embodiment, the light-emitting circuit 5130 may further include first to fifth diodes DID1 to DID5 for preventing backflow. The first diode DID1 is connected between the first power node VPND and the first light-emitting diode group LED1, and blocks the current flowing from the first light-emitting diode group LED1 to the first power node VPND. The second diode DID2 is connected between the output terminal of the first light-emitting diode group LED1 (or the input terminal of the second light-emitting diode group LED2) and the capacitor Cp, and blocks the current flowing from the capacitor Cp to the output terminal of the first light-emitting diode group LED1. The third diode DID3 is connected between the capacitor Cp and the input terminal of the first light-emitting diode group LED1, and blocks the current flowing from the input terminal of the first light-emitting diode group LED1 to the capacitor Cp. The fourth and fifth diodes DID4 and DID5 are connected between a ground node (that is, the second power node VNND) and the first driving node D1, and a branch node between the fourth and fifth diodes DID4 and DID5 is connected to the capacitor Cp. The fourth diode DID4 blocks the current flowing from the corresponding branch node to the ground node, and the fifth diode DID5 blocks the current flowing from the first driving node D1 to the corresponding branch node.

The LED driver 5140 is connected to the light-emitting circuit 5130 through the first and second driving nodes D1 and D2. The LED driver 5140 is configured to drive the light-emitting circuit 5130 by applying first and second driving currents DI1 and DI2 to the first and second driving nodes D1 and D2, respectively. As the level of each driving current is high, the amount of light emitted by a light-emitting diode group through which the corresponding driving current flows increases.

The LED driver 5140 adjusts the respective levels of the first and second driving currents DI1 and DI2 depending on the voltage of a driving current setting node DISND. The voltage of the driving current setting node DISND may be a DC voltage. When the voltage of the driving current setting node DISND increases, the LED driver 5140 may increase the levels of the first and second driving currents DI1 and DI2. When the voltage of the driving current setting node DISND decreases, the LED driver 5140 may decrease the levels of the first and second driving currents DI1 and DI2.

The driving current setting circuit 5150 adjusts the voltage of the driving current setting node DISND depending on a driving current control signal DICS. The driving current control signal DICS may have a DC voltage.

The relationship between the voltage level of the driving current control signal DICS and the voltage level of the driving current setting node DISND may be changed depending on the internal components of the driving current setting circuit 5150. For example, the driving current setting circuit 5150 may decrease the voltage of the driving current setting node DISND as the voltage of the driving current control signal DICS decreases. As another example, the driving current setting circuit 5150 may decrease the voltage of the driving current setting node DISND as the voltage of the driving current control signal DICS increases. Hereinbelow, it is assumed for the sake of convenience in explanation that the driving current setting circuit 5150 is configured to decrease the voltage of the driving current setting node DISND as the voltage of the driving current control signal DICS decreases.

The driving current controller 5160 receives a dimming signal DS. The dimming signal DS may have a dimming level which is determined depending on the degree of modulation of the rectified voltage Vrct.

The dimming signal DS provided to the driving current controller 5160 may be provided in various methods. In the illustrated embodiment, the dimming signal DS may be generated by the dimmer 5115 and be provided to the driving current controller 5160 through a dimming node ADIMND shown in FIG. 19.

In an embodiment, the dimming signal DS may be a DC voltage indicative of a dimming level. For example, the dimming signal DS may be a DC voltage which has a level of 0V to 3V. In another embodiment, the dimming signal DS may be a pulse width modulated signal indicative of a dimming level. In this case, the driving current controller 5160 may include a component such as an integrator circuit for converting the pulse width modulated signal into a voltage level.

The driving current controller 5160 is configured to adjust the driving current control signal DICS depending on the dimming level indicated by the dimming signal DS. The voltage level of the driving current control signal DICS may increase as the dimming level increases, and may decrease as the dimming level decreases.

The current blocking circuit 5170 receives the dimming signal DS. The current blocking circuit 5170 is configured to monitor the dimming signal DS and output a blocking signal STS when the dimming level is relatively low. The blocking signal STS may be provided to the driving current setting circuit 5150. When the blocking signal STS is enabled, the driving current setting circuit 5150 may control the LED driver 5140 to block the driving currents DI1 and DI2. When the blocking signal STS is disabled, the driving current setting circuit 5150 may control the LED driver 5140 to unblock the driving currents DI1 and DI2.

In another embodiment, the blocking signal STS may be provided to the LED driver 5140. The LED driver 5140 may block the driving currents DI1 and DI2 in response to the blocking signal STS. For example, components such as the operational amplifiers included in the LED driver 5140 may be deactivated in response to the blocking signal STS.

As the driving currents DI1 and DI2 are blocked depending on the dimming level, it is possible to prevent the light-emitting circuit 5130 from exhibiting undesired light-emitting characteristics due to a low dimming level. For example, it is possible to prevent the light-emitting diode groups LED1 and LED2 from flickering. Accordingly, the operational reliability of the lighting apparatus 5100 may be improved. This will be described in detail with reference to FIG. 23.

The current blocking circuit 5170 includes a hysteresis comparator 5171. The hysteresis comparator 5171 may enable the blocking signal STS when the dimming level indicated by the dimming signal DS decreases and becomes lower than a first threshold value, and may disable the blocking signal STS when the dimming level increases and becomes higher than a second threshold value. The second threshold value is higher than the first threshold value.

It is assumed that the current blocking circuit 5170 generates the blocking signal STS depending on whether or not the dimming level is lower than one threshold value. Due to the noise included in the dimming signal DS, the intentional adjustment of the dimming signal DS, etc., the dimming level may vary in a range that is similar to the threshold value. Due to this fact, the blocking signal STS may be repeatedly enabled and disabled. This means that the driving currents DI1 and DI2 are repeatedly blocked and unblocked and thus the light-emitting diodes of the light-emitting circuit 5130 flicker.

According to one embodiment of the invention, the current blocking circuit 5170 may generate the blocking signal STS by using a hysteresis scheme. Due to this fact, even if the dimming level varies in a relatively low range, it is possible to effectively prevent the light-emitting diode groups LED1 and LED2 from flickering. Accordingly, the operational reliability of the lighting apparatus 5100 may be improved.

The DC power source 5180 is connected between the first power node VPND and the second power node VNND, and is configured to generate a DC voltage VCC by using the rectified voltage Vrct. In another example, the DC power source 5180 may generate the DC voltage VCC by using the AC voltage Vac or the output voltage of the dimmer 5115. In an embodiment, the DC power source 5180 may be a band gap reference circuit. The DC voltage VCC may be provided as the operating voltage of the LED driver 5140, the driving current setting circuit 5150, the driving current controller 5160 and the current blocking circuit 5170.

Figure 21:
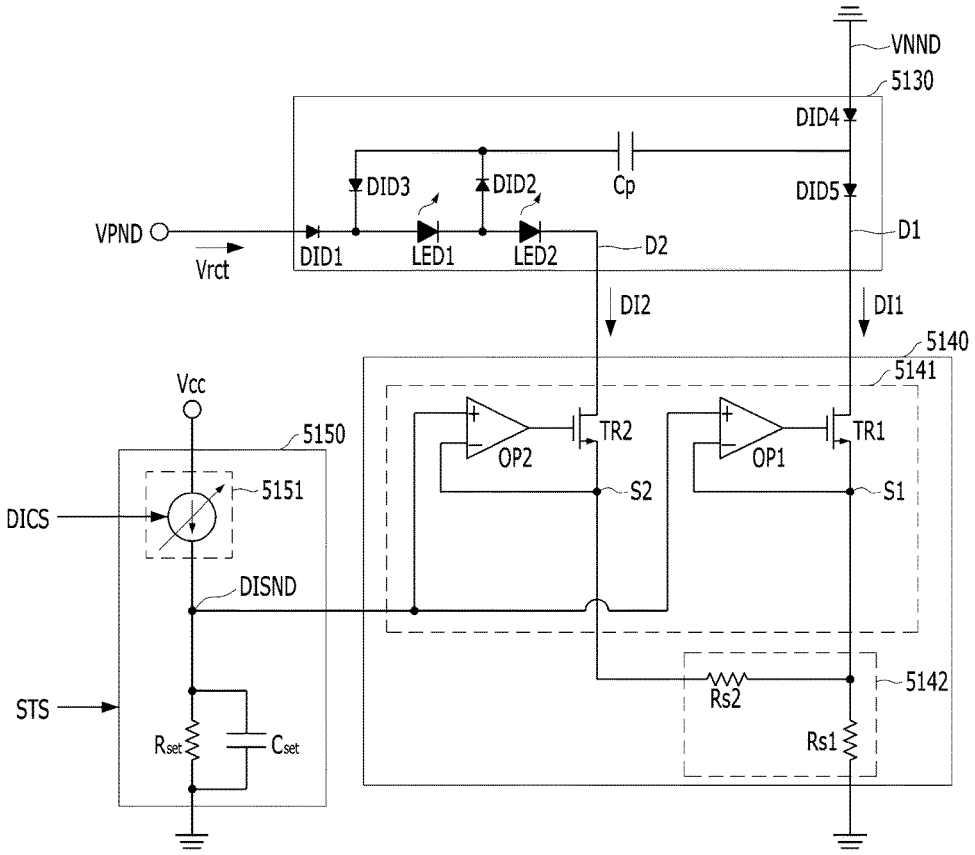
FIG. 21 is a circuit diagram illustrating embodiments of the light-emitting circuit, the LED driver and the driving current setting circuit of FIG. 19.

FIG. 21 is a circuit diagram illustrating embodiments of the light-emitting circuit 5130, the LED driver 5140 and the driving current setting circuit 5150 of FIG. 19.

Referring to FIG. 21, the LED driver 5140 may include an LED driving circuit 5141 which is connected to the light-emitting circuit 5130 through the first and second driving nodes D1 and D2 and is connected to the driving current setting circuit 5150 through the driving current setting node DISND, and a resistor circuit 5142 which is connected to the LED driving circuit 5141 through first and second source nodes S1 and S2.

The LED driving circuit 5141 may include a first transistor TR1 and a first comparator OP1 for controlling the first driving node D1, and a second transistor TR2 and a second comparator OP2 for controlling the second driving node D2.

The first transistor TR1 is connected between the first driving node D1 and the first source node S1. The first comparator OP1 has an output terminal which is connected to the gate of the first transistor TR1 and an inverting terminal which is connected to the first source node S1. The second transistor TR2 is connected between the second driving node D2 and the second source node S2. The second comparator OP2 has an output terminal which is connected to the gate of the second transistor TR2 and an inverting terminal which is connected to the second source node S2. The non-inverting terminals of the first and second comparators OP1 and OP2 may be connected in common to the driving current setting node DISND. The first and second transistors TR1 and TR2 may be NMOS transistors.

When the voltage of the first source node S1 is lower than the voltage of the driving current setting node DISND, the first transistor TR1 may be turned on by the output of the first comparator OP1. When the voltage of the first source node S1 becomes higher than the voltage of the driving current setting node DISND by the rectified voltage Vrct, the first transistor TR1 may be turned off by the output of the first comparator OP1. In this manner, the first transistor TR1 may be repeatedly turned on and off. Due to this fact, the voltage of the driving current setting node DISND may be reflected on the voltage of the first source node S1. Similarly, the voltage of the driving current setting node DISND may be reflected on the voltage of the second source node S2.

A first source resistor Rs1 is connected between the first source node S1 and the ground node. Therefore, depending on the voltage of the first source node S1 and the first source resistor Rs1, the level of the first driving current DI1 may be determined. A second source resistor Rs2 is connected between the second source node S2 and the first source node S1. Therefore, depending on the voltage of the second source node S2 and the sum of the first and second source resistors Rs1 and Rs2, the level of the second driving current DI2 may be determined. For example, the level of the second driving current DI2 may be lower than the level of the first driving current DI1.

In this way, the levels of the first and second driving currents DI1 and DI2 may be respectively controlled depending on the voltage of the driving current setting node DISND. As the voltage of the driving current setting node DISND increases, the respective levels of the first and second driving currents DI1 and DI2 may increase.

The driving current setting circuit 5150 may include a voltage adjuster 5151 and a setting resistor Rset.

The setting resistor Rset is connected between the driving current setting node DISND and the ground node. The setting resistor Rset has a predetermined resistance value such that the voltage of the driving current setting node DISND falls within a desired voltage range. In order to eliminate the voltage noise of the driving current setting node DISND, a setting capacitor Cset which is connected in parallel with the setting resistor Rset may be additionally provided.

The voltage adjuster 5151 applies a voltage to the driving current setting node DISND depending on the driving current control signal DICS. The voltage adjuster 5151 may include a variable current source which generates a current varying depending on the driving current control signal DICS.

The driving current setting circuit 5150 receives the blocking signal STS from the current blocking circuit 5170. The driving current setting circuit 5150 may block the driving currents DI1 and DI2 when the blocking signal STS is received. It is to be understood that the driving currents DI1 and DI2 may be blocked by using various methods. For example, the driving current setting circuit 5150 may block the driving currents DI1 and DI2 by applying a ground voltage to the driving current setting node DISND in response to the blocking signal STS. Otherwise, the driving current setting circuit 5150 may block the driving currents DI1 and DI2 by deactivating the first and second comparators OP1 and OP2 of the LED driver 5140 in response to the blocking signal STS.

Figure 22:
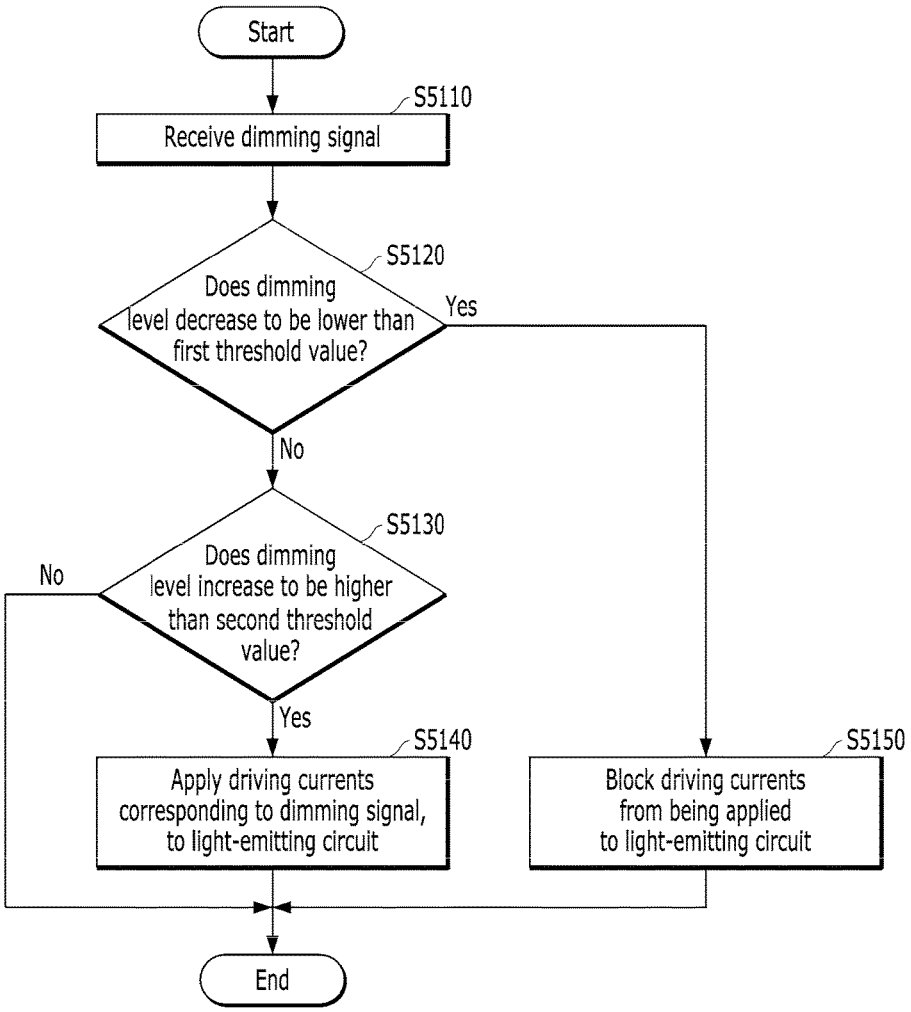
FIG. 22 is an exemplary flow chart to assist in the explanation of a method for driving light-emitting diodes in accordance with an embodiment of the invention.

FIG. 22 is an exemplary flow chart to assist in the explanation of a method for driving light-emitting diodes in accordance with an embodiment of the invention.

Referring to FIGS. 19 and 22, at step S5110, the dimming signal DS is received. At step S5120, whether the dimming level indicated by the dimming signal DS decreases and becomes lower than the first threshold value is determined. If so, step S5150 is performed. If not so, step S5130 is performed.

At the step S5130, whether the dimming level increases and becomes higher than the second threshold value higher than the first threshold value is determined. If so, step S5140 is performed.

At the step S5140, the driving currents DI1 and DI2 corresponding to the dimming signal DS are applied to the light-emitting circuit 5130. As the driving currents DI1 and DI2 are applied depending on the rectified voltage Vrct, the light-emitting diode groups LED1 and LED2 may emit light. If the driving currents DI1 and DI2 are in a state in which they are blocked before the step S5140, the driving currents DI1 and DI2 are unblocked at the step S5140. If the driving currents DI1 and DI2 are in a state in which they flow before the step S5140, the driving currents DI1 and DI2 are continuously applied at the step S5140.

At the step S5150, the driving currents DI1 and DI2 applied to the light-emitting circuit 5130 are blocked.

According to one embodiment of the invention, as the driving currents DI1 and DI2 are blocked depending on the dimming level, it is possible to prevent the light-emitting circuit 5130 from exhibiting undesired light-emitting characteristics due to a low dimming level. Further, by blocking and unblocking the driving currents DI1 and DI2 through comparing the dimming level with the first and second threshold values, even if the dimming level varies within a range that is similar to the first and second threshold values, it is possible to effectively prevent the light-emitting diode groups LED1 and LED2 from flickering.

Figure 23:
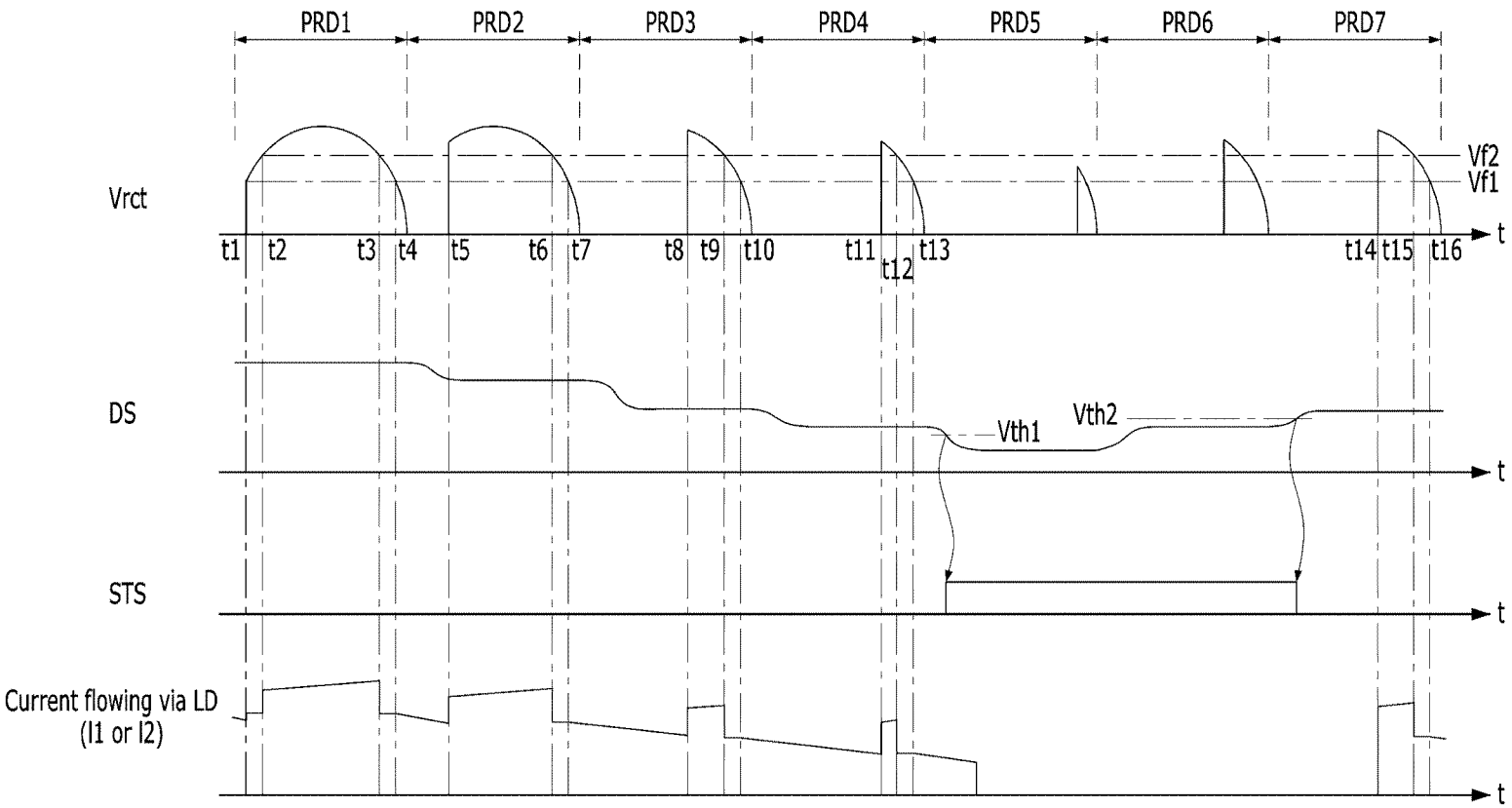
FIG. 23 is an exemplary timing diagram to assist in the explanation of a method for driving light-emitting diodes in accordance with an embodiment of the invention.

FIG. 23 is an exemplary timing diagram to assist in the explanation of a method for driving light-emitting diodes in accordance with an embodiment of the invention.

Referring to FIGS. 19 and 23, the rectified voltage Vrct is received. The rectified voltage Vrct may be phase-cut depending on a user's choice. In FIG. 23, seven periods PRD1 to PRD7 of the rectified voltage Vrct are exemplarily shown. The phase of each of the plurality of periods PRD1 to PRD7 of the rectified voltage Vrct may be adjusted by the user's selection.

At a first time t1, the rectified voltage Vrct of the first period PRD1 increases and reaches a first voltage Vf1. The dimming signal DS which has a dimming level determined depending on the degree of modulation of the rectified voltage Vrct is received. For example, a dimming level may correspond to the area indicated by each period of the rectified voltage Vrct. In FIG. 23, it is exemplified that the dimming signal DS is provided as a DC voltage. In this case, a dimming level may be the level of the DC voltage. Since the voltage level of the dimming signal DS is higher than a first threshold value Vth1, the blocking signal STS may be disabled. For example, the blocking signal STS may have the logic value of 0. Accordingly, the first and second driving currents DI1 and DI2 are applied depending on the rectified voltage Vrct and drive the light-emitting circuit 5130.

A scheme in which the light-emitting circuit 5130 is driven depending on the level of the rectified voltage Vrct may be changed variously depending on the components of the light-emitting circuit 5130, the connection relationship among corresponding components, the number of driving nodes between the light-emitting circuit 5130 and the LED driver 5140, and so forth. Hereunder, a scheme in which the light-emitting circuit 5130 is driven will be described based on the light-emitting circuit 5130 shown in FIG. 19.

The first voltage Vf1 may be the sum of the forward voltages of the first and second light-emitting diode groups LED1 and LED2. An input current from the first power node VPND may apply the second driving current DI2 by flowing through the first and second light-emitting diode groups LED1 and LED2 and the second driving node D2. Due to this fact, the first and second light-emitting diode groups LED1 and LED2 emit light.

At a second time t2, the rectified voltage Vrct of the first period PRD1 increases and reaches a second voltage Vf2. The second voltage Vf2 may be the sum of the forward voltage of the first light-emitting diode group LED1 and the voltage of both ends of the capacitor Cp. In other words, the voltage of both ends of the capacitor Cp may be higher than the forward voltage of the second light-emitting diode group LED2. At the second time t2, the input current from the first power node VPND may apply the first driving current DI1 by flowing through the first light-emitting diode group LED1, the capacitor Cp and the first driving node D1. Due to this fact, the first light-emitting diode group LED1 emits light, and the capacitor Cp is charged.

Meanwhile, referring to FIG. 21, the first and second driving currents DI1 and DI2 flow in common to the ground through the resistor Rs1, and the second driving current DI2 reaches the resistor Rs1 by additionally passing through the resistor Rs2 when compared to the first driving current DI1. Due to this fact, since the first driving current DI1 flows at the second time t2, the second driving current DI2 may be blocked because it should additionally pass through the resistor Rs2. For example, when the first driving current DI1 begins to flow, the second driving current DI2 may be gradually blocked. As a result, the first driving current DI1 is applied between the second time t2 and a third time t3.

At the third time t3, the rectified voltage Vrct of the first period PRD1 becomes lower than the second voltage Vf2. Namely, the level of the rectified voltage Vrct is lower than the sum of the forward voltage of the first light-emitting diode group LED1 and the voltage of both ends of the capacitor Cp. Accordingly, the first driving current DI1 which flows through the first light-emitting diode group LED1, the capacitor Cp and the first driving node D1 is blocked. Conversely, at the third time t3, the rectified voltage Vrct of the first period PRD1 is higher than the first voltage Vf1. Due to this fact, the second driving current D12 flows from the first power node VPND through the first and second light-emitting diode groups LED1 and LED2 and the second driving node D2.

At a fourth time t4, the rectified voltage Vrct of the first period PRD1 further decreases and becomes lower than the first voltage Vf1. That is to say, the level of the rectified voltage Vrct is lower than the sum of the forward voltages of the first and second light-emitting diode groups LED1 and LED2. Accordingly, the second driving current D12 which flows through the first and second light-emitting diode groups LED1 and LED2 and the second driving node D2 is blocked.

Conversely, the voltage of both ends of the charged capacitor Cp may be higher than the first voltage Vf1. The charges charged in the capacitor Cp applies the second driving current D12 by flowing through the first and second light-emitting diode groups LED1 and LED2 and the second driving node D2. For example, while the level of the rectified voltage Vrct is lower than the voltage of both ends of the capacitor Cp, the second driving current D12 may flow by the charges charged in the capacitor Cp.

At a fifth time t5, the rectified voltage Vrct of the second period PRD2 is higher than the second voltage Vf2. The input current of the first power node VPND may apply the first driving current DI1 by flowing through the first light-emitting diode group LED1, the capacitor Cp and the first driving node D1. Meanwhile, the voltage level of the dimming signal DS corresponding to the second period PRD2 is lower than that corresponding to the first period PRD1. Accordingly, the first driving current DI1 flowing in the second period PRD2 may be lower than the first driving current DI1 flowing in the first period PRD1.

At a sixth time t6, the rectified voltage Vrct of the second period PRD2 becomes lower than the second voltage Vf2 and is higher than the first voltage Vf1. The first driving current DI1 is blocked, and the input current of the first power node VPND may apply the second driving current DI2 by flowing through the first and second light-emitting diode groups LED1 and LED2 and the second driving node D2. Meanwhile, since the voltage of the dimming signal DS corresponding to the second period PRD2 is lower than that corresponding to the first period PRD1, the second driving current DI2 flowing in the second period PRD2 may be lower than the second driving current DI2 flowing in the first period PRD1.

At a seventh time t7, the rectified voltage Vrct of the second period PRD2 further decreases and becomes lower than the first voltage Vf1. The second driving current DI2 flowing from the first power node VPND is blocked, and the second current DI2 is applied as the charges of the capacitor Cp flow through the first and second light-emitting diode groups LED1 and LED2 and the second driving node D2.

Operations corresponding to an eighth time t8, a ninth time t9 and a tenth time t10 in the third period PRD3 may be described in a manner similar to the fifth time t5, the sixth time t6 and the seventh time t7, respectively, in the second period PRD2. Operations corresponding to an eleventh time t11, a twelfth time t12 and a thirteenth time t13 in the fourth period PRD4 may also be described in a manner similar to the fifth time t5, the sixth time t6 and the seventh time t7, respectively, in the second period PRD2. In the respective periods, the light-emitting circuit 5130 is driven by being applied with the first and second driving currents DI1 and DI2 depending on the level of the rectified voltage Vrct.

In the fifth period PRD5, the voltage level of the dimming signal DS decreases and becomes lower than the first threshold value Vth1. According to this fact, the blocking signal STS is enabled. For example, the blocking signal STS may transition to the logic value of 1. In response to that the blocking signal STS is enabled, the driving currents DI1 and DI2 applied to the light-emitting circuit 5130 are blocked.

It is assumed that the driving currents DI1 and DI2 are not blocked even though the voltage level of the dimming signal DS is lower than the first threshold value Vth1. The rectified voltage Vrct of the fifth period PRD5 has a voltage level higher than the first voltage Vf1, but does not have a voltage level higher than the second voltage Vf2. When the rectified voltage Vrct of the fifth period PRD5 begins to be provided, the input current of the first power node VPND may apply the second driving current DI2 by flowing through the first and second light-emitting diode groups LED1 and LED2 and the second driving node D2. Then, when the rectified voltage Vrct of the fifth period PRD5 becomes lower than the first voltage Vf1, the second driving current DI2 flowing from the first power node VPND is blocked, and the charges of the capacitor Cp may flow through the first and second light-emitting diode groups LED1 and LED2 and the second driving node D2 and apply the second current DI2. In the fifth period PRD5, the input current of the first power node VPND does not flow through the first light-emitting diode group LED1 and the capacitor Cp. Accordingly, the capacitor Cp may not be charged. In the case where periods having degrees of modulation similar to the fifth period PRD5 are repeatedly received following the fifth period PRD5, the capacitor Cp may be discharged. This means that the second driving current DI2 cannot be applied from the charges of the capacitor Cp, and according to this fact, the light-emitting circuit 5130 may flicker in an undesirable manner at a certain time interval of each period. In other words, when the driving currents DI1 and DI2 are not blocked even though the voltage level of the dimming signal DS is lower than the first threshold value Vth1, the light-emitting circuit 5130 may exhibit undesired light-emitting characteristics.

According to one embodiment of the invention, when the voltage level of the dimming signal DS decreases and becomes lower than the first threshold value Vth1, the blocking signal STS is enabled and the driving currents DI1 and DI2 applied to the light-emitting circuit 5130 are blocked. Accordingly, it is possible to prevent the light-emitting circuit 5130 from exhibiting undesired light-emitting characteristics.

In the sixth period PRD6, the voltage level of the dimming signal DS is lower than a second threshold value Vth2. The second threshold value Vth2 is higher than the first threshold value Vth1. Since the voltage level of the dimming signal DS is lower than the second threshold value Vth2, the blocking signal STS is continuously enabled. In the sixth period PRD6, the voltage level of the dimming signal DS may be higher than the first threshold value Vth1 but be lower than the second threshold value Vth2.

It is assumed that the driving currents DI1 and DI2 are unblocked in response to that the voltage level of the dimming signal DS is higher than the first threshold value Vth1. When periods having dimming levels of a range similar to the first threshold value Vth1 are received following the sixth period PRD6, the driving currents DI1 and DI2 may be repeatedly blocked and unblocked. This means that the light-emitting circuit 5130 flickers in an undesirable manner.

According to one embodiment of the invention, by unblocking the driving currents DI1 and DI2 through using the second threshold value Vth2 higher than the first threshold value Vth1, it is possible to prevent the light-emitting circuit 5130 from flickering in an undesirable manner.

In the seventh period PRD7, the voltage level of the dimming signal DS increases and becomes higher than the second threshold value Vth2. Due to this fact, the blocking signal STS may be disabled to, for example, the logic value of 0. This may mean that the driving currents DI1 and DI2 applied to the light-emitting circuit 5130 are unblocked. Due to this fact, the light-emitting circuit 5130 may receive the first and second driving currents DI1 and DI2 depending on the level of the rectified voltage Vrct and may emit light. Operations corresponding to a fourteenth time t14, a fifteenth time t15 and a sixteenth time t16 may be described in a manner similar to the fifth time t5, the sixth time t6 and the seventh time t7, respectively, in the second period PRD2.

Figure 24:
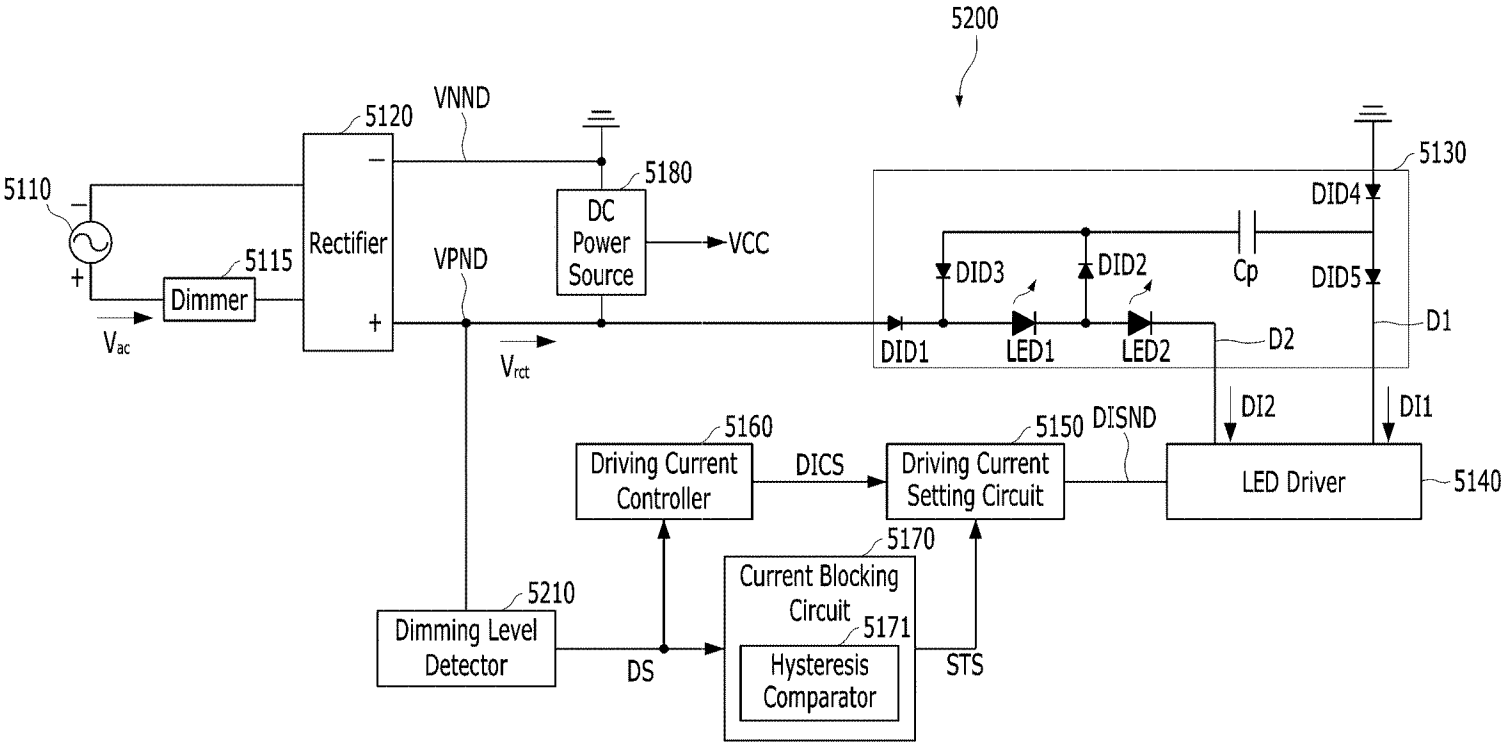
FIG. 24 is a block diagram illustrating a lighting apparatus constructed in accordance with an embodiment of the invention.
Figure 25:
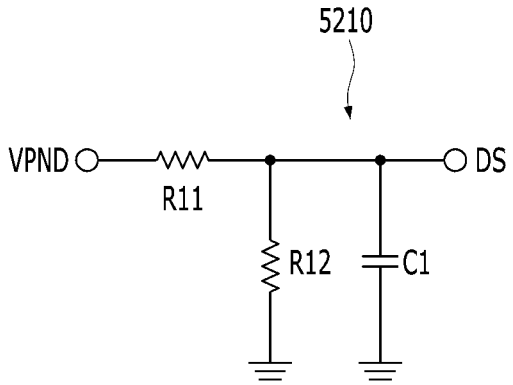
FIG. 25 is a circuit diagram illustrating an embodiment of the dimming level detector of FIG. 24.

FIG. 24 is a block diagram illustrating a lighting apparatus constructed in accordance with an embodiment of the invention. FIG. 25 is a circuit diagram illustrating an embodiment of the dimming level detector of FIG. 24.

Referring to FIG. 24, the lighting apparatus 5200 may further include the dimming level detector 5210 which is configured to output a DC voltage having a level varying depending on the rectified voltage Vrct, as the dimming signal DS. The dimming level detector 5210 may output the dimming signal DS by averaging the rectified voltage Vrct. For example, the dimming level detector 5210 may output the dimming signal DS of 3V in the case where a dimming level selected by a user is 100%, may output the dimming signal DS of 2.7V in the case where a dimming level selected by a user is 90%, and may output the dimming signal DS of 1.5V in the case where a dimming level selected by a user is 50%.

In an embodiment, the dimming level detector 5210 may be an RC integrator circuit. Referring to FIG. 25, the dimming level detector 5210 may include first and second resistors R11 and R12 and a capacitor C1. The first resistor R11 is connected between the first power node VPND and an output node which outputs the dimming signal DS. The second resistor R12 and the capacitor C1 are connected between the output node which outputs the dimming signal DS and the ground (for example, the second power node VNND). According to this embodiment, the dimming level detector 5210 may function as an integrator circuit.

Figure 26:
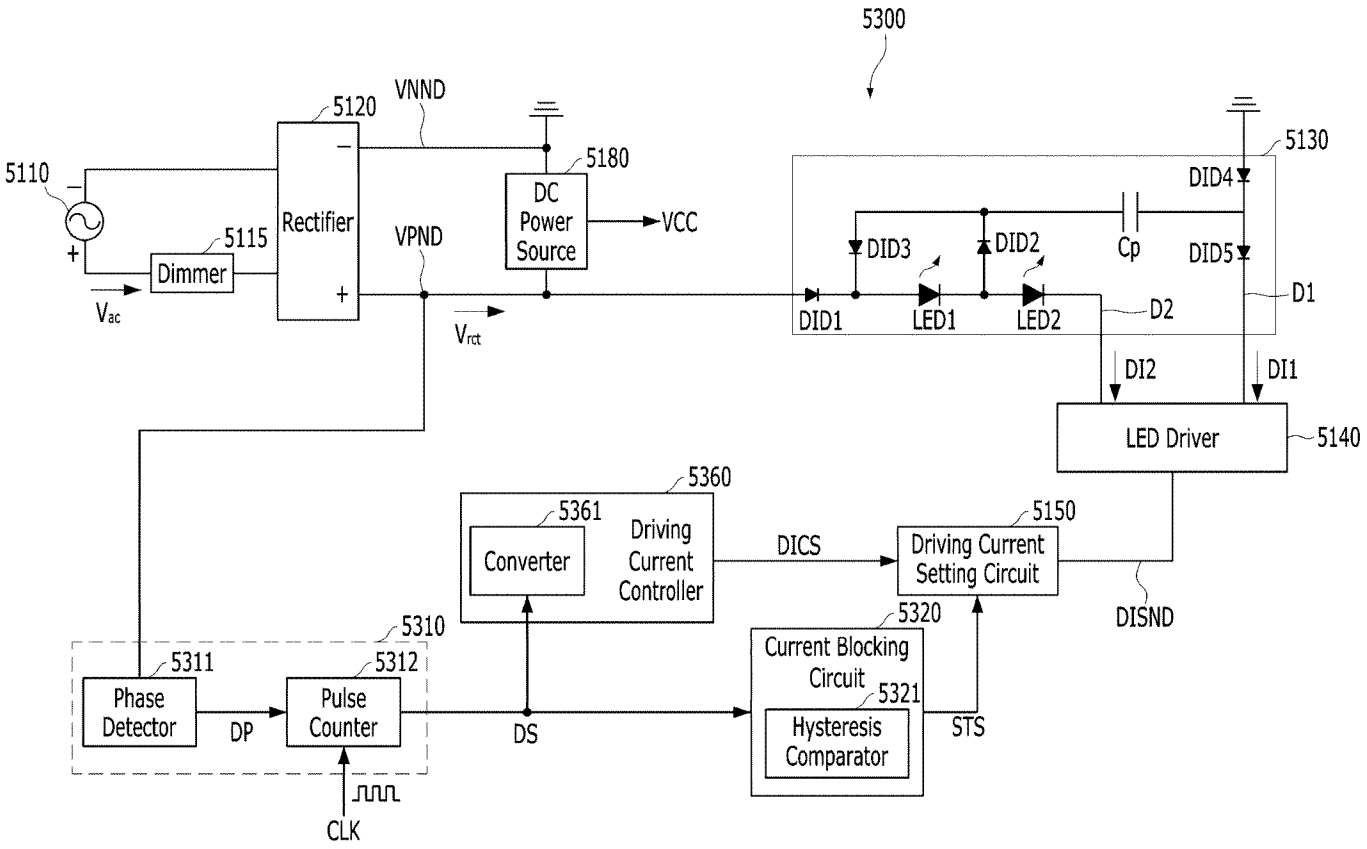
FIG. 26 is a block diagram illustrating a lighting apparatus constructed in accordance with an embodiment of the invention.

FIG. 26 is a block diagram illustrating a lighting apparatus constructed in accordance with an embodiment of the invention.

Referring to FIG. 26, the lighting apparatus 5300 may further include a dimming level detector 5310 which is configured to output a count value varying depending on the rectified voltage Vrct, as the dimming signal DS. The count value of the dimming signal DS may indicate a dimming level. The dimming level detector 5310 may include a phase detector 5311 and a pulse counter 5312. The phase detector 5311 is configured to output a dimming phase signal DP when the rectified voltage Vrct is equal to or higher than a predetermined voltage level, for example, 0.3V. The dimming phase signal DP may include information indicative of the phase at which the modulated rectified voltage Vrct is provided. The pulse counter 5312 receives a clock signal CLK. The pulse counter 5312 is configured to count the pulses of the clock signal CLK which toggles while the dimming phase signal DP is received, and output a counted value as the dimming signal DS.

A current blocking circuit 5320 may enable the blocking signal STS when the received count value decreases and becomes lower than a first threshold value. The current blocking circuit 5320 may disable the blocking signal STS when the received count value increases and becomes higher than a second threshold value higher than the first threshold value. The current blocking circuit 5320 may include a hysteresis comparator 5321 for providing such a hysteresis function.

In the illustrated embodiment, a driving current controller 5360 may include a converter 5361 which is configured to convert the count value into a DC voltage level. Based on the converted DC voltage level, the driving current controller 5360 may generate the driving current control signal DICS.

Figure 27:
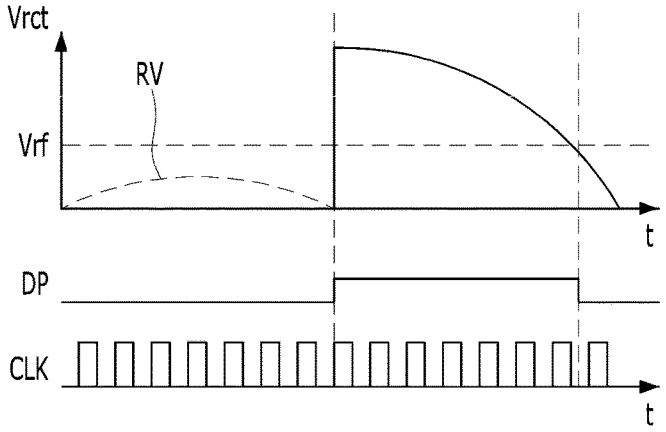
FIG. 27 is a timing diagram showing the rectified voltage, the dimming phase signal and the clock signal of FIG. 26.

FIG. 27 is a timing diagram showing the rectified voltage Vrct, the dimming phase signal DP and the clock signal CLK of FIG. 26.

Referring to FIG. 27, the modulated rectified voltage Vrct is provided. When the level of the rectified voltage Vrct is higher than a reference voltage Vrf, the dimming phase signal DP may be enabled. For example, the reference voltage Vrf may be 0.3V. A time at which the dimming phase signal DP is enabled may be related with a phase at which the modulated rectified voltage Vrct is provided.

The pulses of the clock signal CLK which toggles when the dimming phase signal DP is enabled is counted. In FIG. 27, while the dimming phase signal DP is enabled, seven pulses are counted. The counted value may be compared with the first and second threshold values, and, according to a comparison result, the blocking signal STS may be enabled or disabled.

The rectified voltage Vrct may have a residual voltage RV corresponding to noise. When the reference voltage Vrf is set to be higher than the residual voltage RV, the residual voltage RV may not be reflected on a dimming level. Therefore, according to the illustrated embodiment, the lighting apparatus 5300 which detects a dimming level of improved reliability is provided.

Figure 28:
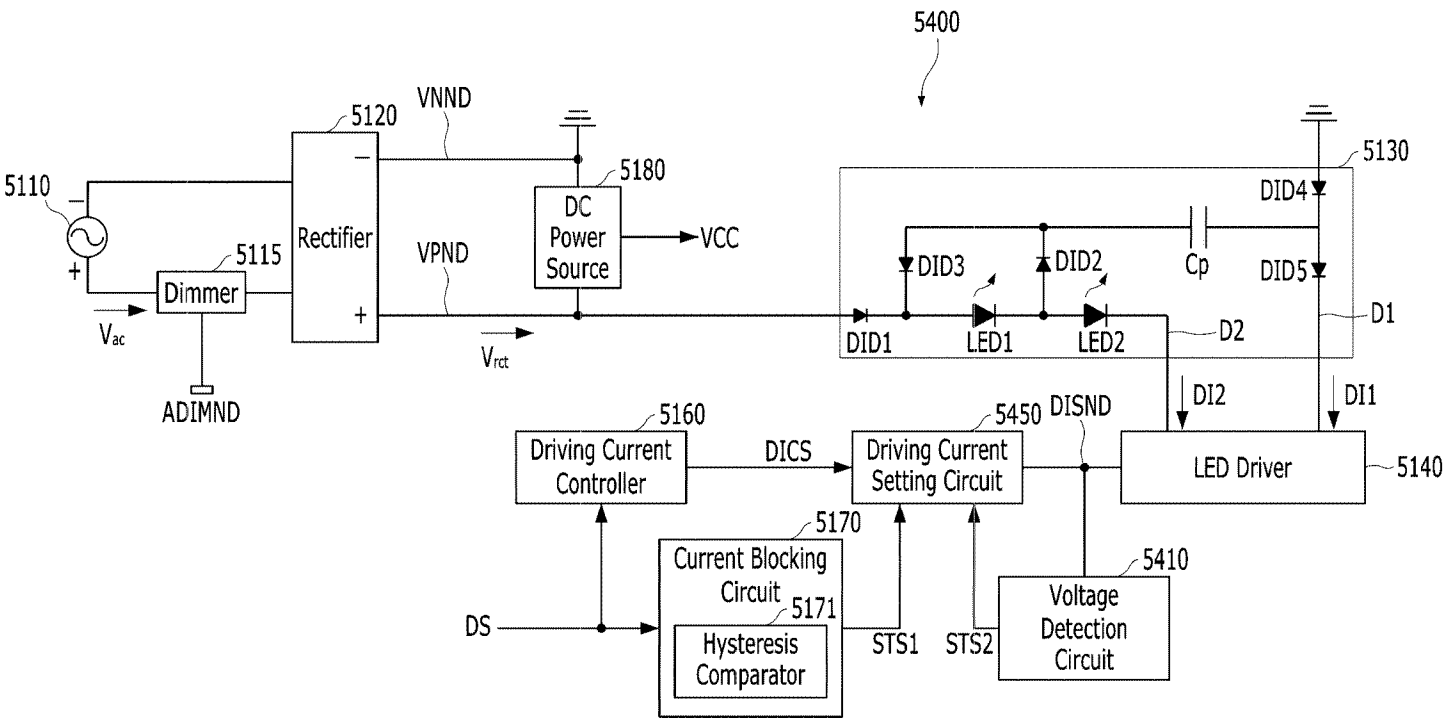
FIG. 28 is a block diagram illustrating a lighting apparatus constructed in accordance with an embodiment of the invention.

FIG. 28 is a block diagram illustrating a lighting apparatus constructed in accordance with an embodiment of the invention.

Referring to FIG. 28, the lighting apparatus 5400 may further include a voltage detection circuit 5410. A driving current setting circuit 5450 receives a first blocking signal STS1 from the current blocking circuit 5170 and receives a second blocking signal STS2 from the voltage detection circuit 5410. The first blocking signal STS1 is described in a manner similar to the blocking signal STS described above with reference to FIG. 19. The driving current setting circuit 5450 may control the LED driver 5140 to block the driving currents DI1 and DI2 in response to the first and second blocking signals STS1 and STS2. In an embodiment, the driving current setting circuit 5450 may block the driving currents DI1 and DI2 when at least one of the first and second blocking signals STS1 and STS2 is enabled.

The voltage detection circuit 5410 is configured to generate the second blocking signal STS2 depending on the voltage of the driving current setting node DISND. As described above with reference to FIG. 21, as the voltage of the driving current setting node DISND increases, the levels of the driving currents DI1 and DI2 may increase. In the case where the voltage of the driving current setting node DISND increases in an undesirable manner, overcurrents may flow through the driving nodes D1 and D2.

According to the illustrated embodiment, the voltage detection circuit 5410 may output the second blocking signal STS2 depending on whether the voltage of the driving current setting node DISND is higher than a threshold voltage or not. According to this fact, even if the voltage of the driving current setting node DISND increases in an undesirable manner, it is possible to prevent overcurrents from flowing through the driving nodes D1 and D2. Therefore, the light-emitting circuit 5130 and the LED driver 5140 are protected from overcurrents.

Figure 29:
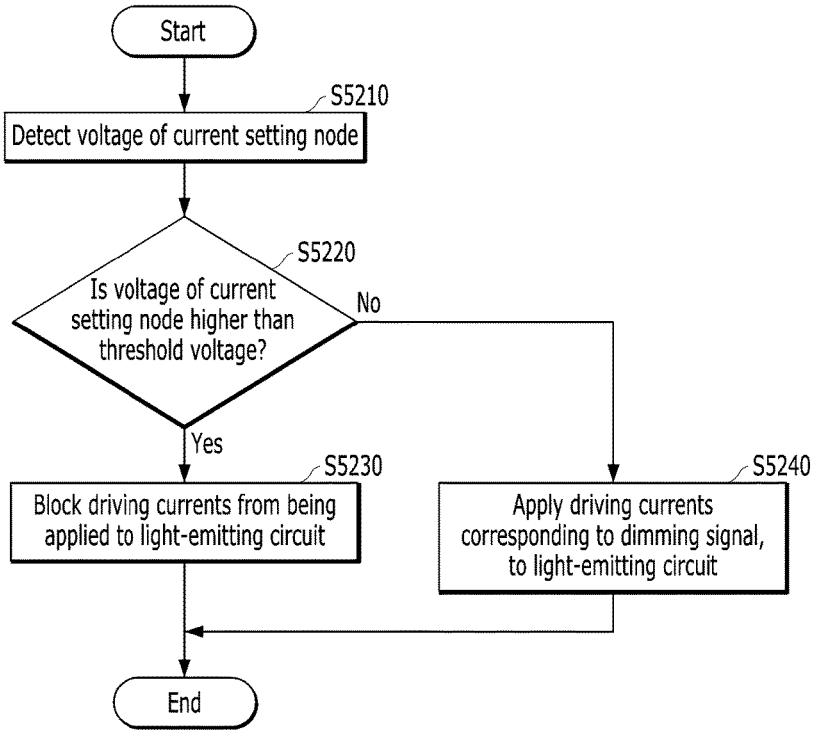
FIG. 29 is an exemplary flow chart to assist in the explanation of a method for driving light-emitting diodes in accordance with an embodiment of the invention.

FIG. 29 is an exemplary flow chart to assist in the explanation of a method for driving light-emitting diodes in accordance with an embodiment of the invention.

Referring to FIGS. 28 and 29, at step S5210, the voltage of the driving current setting node DISND is detected. At step S5220, whether the voltage of the driving current setting node DISND is higher than the threshold voltage or not is determined. If so, step S5230 is performed. If not so, step S5240 is performed.

At the step S5230, the driving currents DI1 and DI2 applied to the light-emitting circuit 5130 are blocked. The second blocking signal STS2 may be enabled. At the step S5240, the driving currents DI1 and DI2 corresponding to the dimming signal DS are applied to the light-emitting circuit 5130. The second blocking signal STS2 may be disabled.

In another embodiment, a hysteresis function may be provided for the detection of the voltage of the driving current setting node DISND. When the voltage of the driving current setting node DISND increases and becomes higher than a first threshold voltage, the second blocking signal STS2 may be enabled and thus the driving currents DI1 and DI2 may be blocked. When the voltage of the driving current setting node DISND decreases and becomes lower than a second threshold voltage lower than the first threshold value, the second blocking signal STS2 may be disabled and thus the driving currents DI1 and DI2 may be applied. In this case, when the voltage of the driving current setting node DISND varies in a range similar to the threshold voltage, it is possible to prevent the light-emitting diode groups LED1 and LED2 from flickering.

Figure 30:
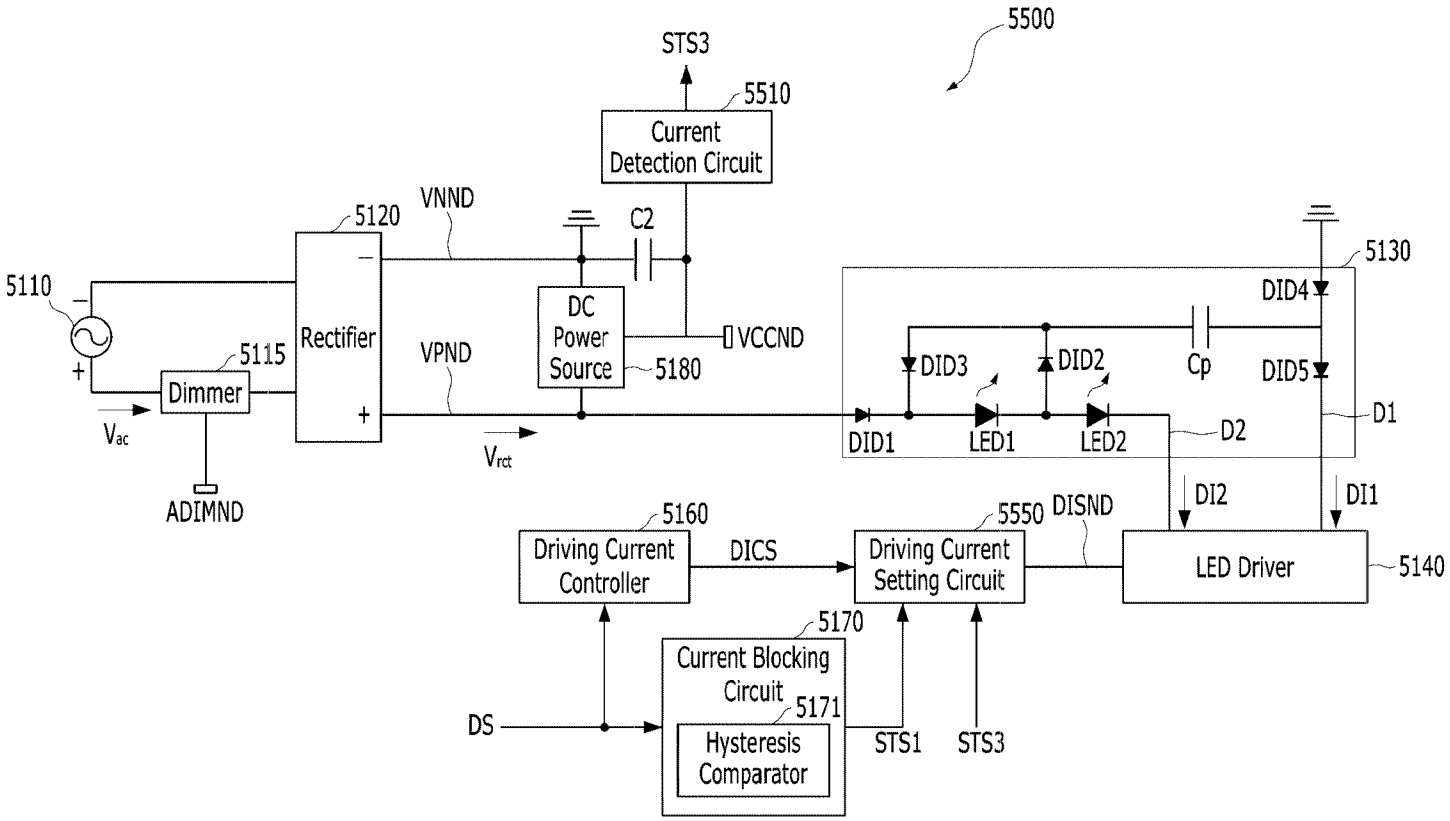
FIG. 30 is a block diagram illustrating a lighting apparatus constructed in accordance with an embodiment of the invention.

FIG. 30 is a block diagram illustrating a lighting apparatus constructed in accordance with an embodiment of the invention.

Referring to FIG. 30, the lighting apparatus 5500 may further include a current detection circuit 5510 which is connected to a DC power node VCCND which outputs a DC voltage. The lighting apparatus 5500 may further include a capacitor C2 which is connected between the DC power node VCCND and the ground such that the noise of the DC voltage is eliminated.

A driving current setting circuit 5550 receives a first blocking signal STS1 from the current blocking circuit 5170 and receives a third blocking signal STS3 from the current detection circuit 5510. The first blocking signal STS1 is described in a manner similar to the blocking signal STS described above with reference to FIG. 19. The driving current setting circuit 5550 may block the driving currents DI1 and DI2 when at least one of the first and third blocking signals STS1 and STS3 is enabled.

The DC voltage may not only be supplied to components inside the lighting apparatus 5500 through the DC power node VCCND but also be provided to an external apparatus through the DC power node VCCND. In the case where an overcurrent is outputted to the external apparatus through the DC power node VCCND, the normal operation of the lighting apparatus 5500 may not be guaranteed. In this case, the operational reliability of the lighting apparatus 5500 may not be guaranteed. According to the illustrated embodiment, the current detection circuit 5510 is configured to generate the third blocking signal STS3 depending on whether the current of the DC power node VCCND is higher than a threshold current or not. According to this fact, it is possible to prevent an overcurrent from flowing through the DC power node VCCND.

Figure 31:
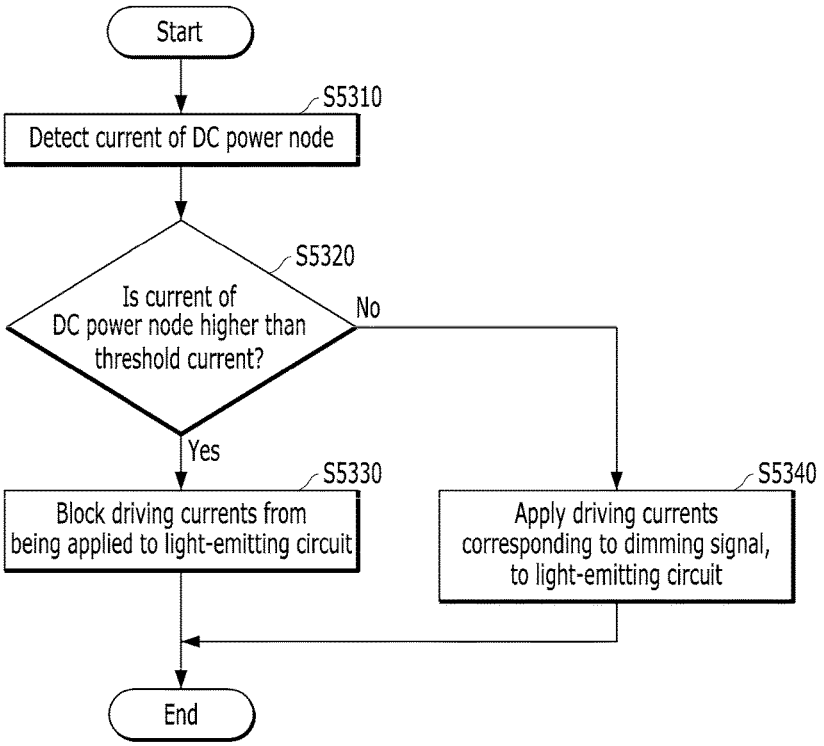
FIG. 31 is an exemplary flow chart to assist in the explanation of a method for driving light-emitting diodes in accordance with an embodiment of the invention.

FIG. 31 is an exemplary flow chart to assist in the explanation of a method for driving light-emitting diodes in accordance with an embodiment of the invention.

Referring to FIGS. 30 and 31, at step S5310, the current of the DC power node VCCND is detected. At step S5320, whether the current of the DC power node VCCND is higher than the threshold current or not is determined. If so, step S5330 is performed. If not so, step S5340 is performed.

At the step S5330, the driving currents DI1 and DI2 applied to the light-emitting circuit 5130 are blocked. The third blocking signal STS3 may be enabled. At the step S5340, the driving currents DI1 and DI2 corresponding to the dimming signal DS are applied to the light-emitting circuit 5130. The third blocking signal STS3 may be disabled.

In another embodiment, a hysteresis function may be provided for the detection of the current of the DC power node VCCND. When the current of the DC power node VCCND increases and becomes higher than a first threshold current, the third blocking signal STS3 may be enabled and thus the driving currents DI1 and DI2 may be blocked. When the current of the DC power node VCCND decreases and becomes lower than a second threshold current lower than the first threshold current, the third blocking signal STS3 may be disabled and thus the driving currents DI1 and DI2 may be applied. In this case, when the current of the DC power node VCCND varies in a range similar to the threshold current, it is possible to prevent the light-emitting diode groups LED1 and LED2 from flickering.

Figure 32:
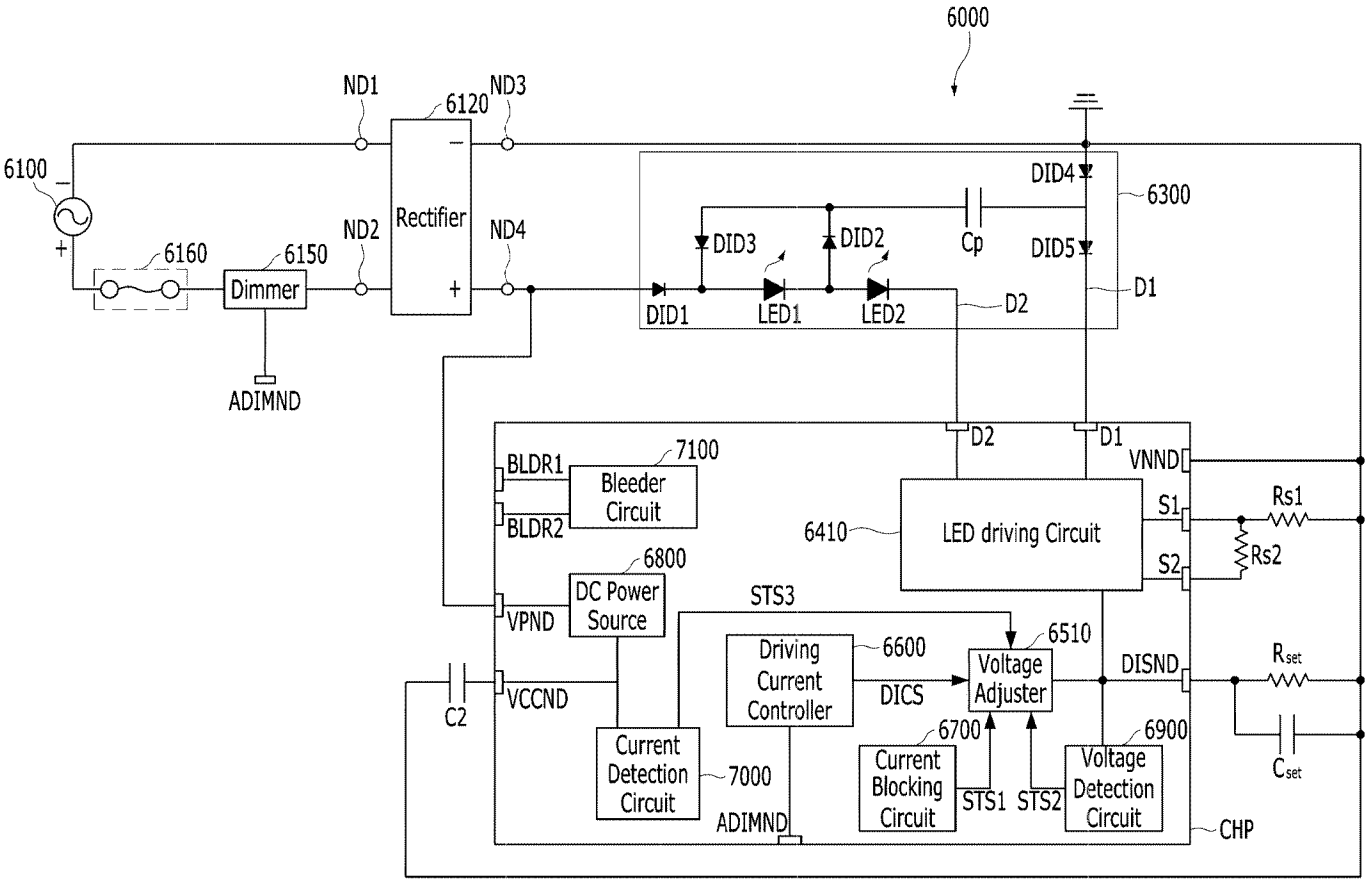
FIG. 32 is a block diagram illustrating an exemplary application of a lighting apparatus constructed in accordance with an embodiment of the invention.

FIG. 32 is a block diagram illustrating an exemplary application of a lighting apparatus constructed in accordance with an embodiment of the invention.

Referring to FIG. 32, the lighting apparatus 6000 is connected to an AC power source 6100. The lighting apparatus 6000 includes a dimmer 6150, a rectifier 6120, a light-emitting circuit 6300, an LED driving circuit 6410, a voltage adjuster 6510, a driving current controller 6600, a current blocking circuit 6700, a DC power source 6800, a voltage detection circuit 6900, a current detection circuit 7000, a capacitor C2, a setting resistor Rset, a setting capacitor Cset and first and second source resistors Rs1 and Rs2.

The lighting apparatus 6000 may further include a fuse 6160. The fuse 6160 may electrically block the lighting apparatus 6000 from the AC power source 6100, for example, when an undesired high voltage is applied from the AC power source 6100.

The LED driving circuit 6410, the voltage adjuster 6510, the driving current controller 6600, the current blocking circuit 6700, the DC power source 6700, the voltage detection circuit 6900 and the current detection circuit 7000 may be mounted in one semiconductor chip CHP. The LED driving circuit 6410 and the voltage adjuster 6510 may be configured in a manner similar to the LED driving circuit 5141 and the voltage adjuster 5151 described above with reference to FIG. 21. The driving current controller 6600, the current blocking circuit 6700 and the DC power source 6800 may be configured in a manner similar to the driving current controller 5160, the current blocking circuit 5170 and the DC power source 5180, respectively, described above with reference to FIG. 19. The driving current controller 6600 and the current blocking circuit 6700 may receive the dimming signal DS (see FIG. 19) through the dimming node ADIMND. The voltage detection circuit 6900 and the current detection circuit 7000 may be configured in a manner similar to the voltage detection circuit 5410 of FIG. 28 and the current detection circuit 5510 of FIG. 30, respectively. The current blocking circuit 6700, the voltage detection circuit 6900 and the current detection circuit 7000 may generate the first to third blocking signals STS1, STS2 and STS3, respectively, as described above with reference to FIGS. 19, 28 and 30. The voltage adjuster 6510 may block or unblock driving currents depending on the generated first to third blocking signals STS1, STS2 and STS3.

In an embodiment, the semiconductor chip CHP may further include at least one of the dimming level detectors 5210 and 5310 described above with reference to FIGS. 24 and 26. In this case, the driving current controller 6600 and the current blocking circuit 6700 may receive the dimming signal DS through corresponding dimming level detectors.

The semiconductor chip CHP may further include a bleeder circuit 7100. The bleeder circuit 7100 may control a triac trigger current between first and second bleeder nodes BLDR1 and BLDR2. The bleeder circuit 7100 may be connected to appropriate nodes depending on the embodiments of the lighting apparatus 6000, the characteristics of the dimmer 6150, the position of the dimmer 6150 in the lighting apparatus 6000, etc. In an embodiment, the first and second bleeder nodes BLDR1 and BLDR2 may be connected to first and second nodes ND1 and ND2, respectively. In another embodiment, the first and second bleeder nodes BLDR1 and BLDR2 may be connected to third and fourth nodes ND3 and ND4, respectively.

The capacitor C2 is connected between the DC voltage node VCCND and the ground as described above with reference to FIG. 30, and eliminates the noise of a DC voltage. The lighting apparatus 6000 may provide the DC voltage to an external apparatus through the DC voltage node VCCND. The setting resistor Rset and the setting capacitor Cset are connected to the voltage adjuster 6510 through a driving current setting node DISND, and may be configured in a manner similar to the setting resistor Rset and the setting capacitor Cset, respectively, described above with reference to FIG. 21. The first and second source resistors Rs1 and Rs2 are connected to the LED driving circuit 6410 through first and second source nodes S1 and S2, respectively, and may be configured in a manner similar to the first and second source resistors Rs1 and Rs2, respectively, described above with reference to FIG. 21.

The capacitor C2, the setting resistor Rset, the setting capacitor Cset and the first and second source resistors Rs1 and Rs2 may be disposed outside the semiconductor chip CHP. In this case, the impedances of the capacitor C2, the setting resistor Rset, the setting capacitor Cset and the source resistors Rs1 and Rs2 may be selected appropriately depending on a user's requirement.

According to exemplary embodiments of the invention, light-emitting diode driving modules and operating methods thereof adaptively cover applications where a dimming function is used and applications where the dimming function is not used without user intervention. For example, according to the principles and exemplary implementations of the invention, a circuit may be provided to detect automatically whether or not a dimmer is being employed during operation.

Light-emitting diode driving modules and operating methods thereof constructed according to embodiments of the invention may employ circuit to automatically prevent flicker without user intervention. For example, the circuit may include a hysteresis comparator operable to blocking current to the driving nodes of the LEDs when a dimming level of the dimming signal decreases lower than a first threshold value and unblock current to the driving nodes when the dimming level of the dimming signal increases above a second threshold value higher than the first threshold value.

In addition, light-emitting diode driving modules and operating methods thereof constructed according to embodiments of the invention also have constant power consumption and improved durability.

Further, light-emitting diode driving modules constructed according to embodiments of the invention, operating methods thereof and lighting apparatus including the same having improved operational reliability.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A light-emitting diode driving module comprising:

an LED driving circuit to activate light-emitting diodes driven by a rectified voltage, and to adjust driving current conducted through driving nodes to the light-emitting diodes depending on a voltage of a driving current setting node; and a driving current controller to control the voltage of the driving current setting node by outputting a driving current control signal, the driving current controller comprising:

a control signal output circuit connected to a dimming node to receive a dimming signal when the rectified voltage is modulated, and to adjust the driving current control signal depending on the dimming signal;

a mode detector to detect whether the rectified voltage is modulated by receiving a source voltage depending on the rectified voltage, and to enable a selection signal depending on a detection result; and a power compensator to adjust the driving current control signal depending on the source voltage when the selection signal is enabled.

2. The light-emitting diode driving module according to claim 1, wherein the mode detector is configured to disable the selection signal when the rectified voltage is modulated and enable the selection signal when the rectified voltage is not modulated.

3. The light-emitting diode driving module according to claim 1, wherein the mode detector is configured to detect whether the rectified voltage is modulated depending on a variation rate of the source voltage.

4. The light-emitting diode driving module according to claim 3, wherein the mode detector disables the selection signal when the variation rate of the source voltage is lower than a threshold value, and enables the selection signal when the variation rate of the source voltage is higher than or equal to the threshold value.

5. The light-emitting diode driving module according to claim 1, wherein the power compensator is configured to adjust the driving current control signal depending on a peak value of the source voltage.

6. The light-emitting diode driving module according to claim 5, wherein the power compensator is configured to adjust the driving current control signal such that the voltage of the driving current setting node decreases as the peak value increases.

7. The light-emitting diode driving module according to claim 5, wherein the power compensator is configured to adjust the driving current control signal such that the voltage of the driving current setting node decreases as the peak value increases, when the peak value is higher than a reference value.

8. The light-emitting diode driving module according to claim 5, wherein the power compensator is configured to apply a control current, which varies depending on the peak value, to the control signal output circuit, and wherein the control signal output circuit is configured to adjust the driving current control signal depending on a level of the control current.

9. The light-emitting diode driving module according to claim 1 in combination with light emitting diodes, and wherein the dimming node is floated when the rectified voltage is not modulated.

10. The light-emitting diode driving module according to claim 1, further comprising:

a driving current setting circuit to control the voltage of the driving current setting node depending on a voltage level of the driving current control signal.

11. The light-emitting diode driving module according to claim 10, further comprising:

a DC power source to generate a DC voltage based upon the rectified voltage, wherein the driving current setting circuit comprises:

a voltage adjuster connected between the DC power source and the driving current setting node to apply a current, which varies depending on a voltage of the driving current control signal, to the driving current setting node.

12. The light-emitting diode driving module according to claim 11, wherein the driving current setting node is connected to a ground node through a resistor.

13. The light-emitting diode driving module according to claim 1, wherein the LED driving circuit comprises:

a first transistor connected between a first driving node of the driving nodes and a first source node;

a first comparator including a non-inverting terminal connected to the driving current setting node, an inverting terminal connected to the first source node and an output terminal connected to a gate of the first transistor;

a second transistor connected between a second driving node of the driving nodes and a second source node; and a second comparator including a non-inverting terminal connected to the driving current setting node, an inverting terminal connected to the second source node and an output terminal connected to a gate of the second transistor, wherein each of the first and second source nodes is connected to a ground node through at least one resistor.

14. The light-emitting diode driving module according to claim 13, further comprising:

a temperature detector to detect temperature in response to generation of a power-on reset signal, and to output a temperature detection signal when the temperature is higher than a pre-determined temperature limit, and wherein the driving current control signal is adjustable depending on the temperature detection signal.

15. The light-emitting diode driving module according to claim 14, wherein the driving current control signal is adjusted such that the voltage of the driving current setting node is retained at a predetermined level when the temperature detection signal is enabled.

16. The light-emitting diode driving module according to claim 1, wherein the source voltage comprises a divided voltage based upon the rectified voltage.

17. A method for driving light-emitting diodes activated by a rectified voltage and controlled through driving nodes, the method comprising the steps of:

determining whether the rectified voltage is modulated, by receiving a source voltage based on the rectified voltage;

when the rectified voltage is not modulated, adjusting current through the driving nodes based on the source voltage; and when the rectified voltage is modulated, adjusting currents conducted to the driving nodes in response to a dimming signal that indicates a degree of modulation of the rectified voltage, without adjusting current conducted to the driving nodes based on the source voltage.

18. The method according to claim 17, wherein the step of determining that the rectified voltage is modulated comprises determining that a variation rate of the source voltage is higher than a threshold value, and wherein the step of determining that the rectified voltage is not modulated comprises determining that a variation rate of the source voltage is lower than or equal to the threshold value.

19. A lighting apparatus comprising:

a light-emitting circuit to receive a rectified voltage, and including light-emitting diodes and a capacitor connected with the light-emitting diodes; and a light-emitting diode driving module connected with the light-emitting circuit through driving nodes, the light-emitting diode driving module comprising:

an LED driver to adjust current conducted to the driving nodes depending on a voltage of a driving current setting node; and a driving current controller to control the voltage of the driving current setting node by outputting a driving current control signal, the driving current controller comprising:

a control signal output circuit connected to a dimming node to receive a dimming signal when the rectified voltage is modulated, and to adjust the driving current control signal depending on the dimming signal;

a mode detector to detect whether the rectified voltage is modulated by receiving a source voltage depending on the rectified voltage, and to enable a selection signal depending on a detection result; and a power compensator to adjust the driving current control signal depending on the source voltage when the selection signal is enabled.

20. The lighting apparatus according to claim 19, wherein:

the LED driver has, during first periods of the rectified voltage, a first driving stage to apply a current from the rectified voltage to at least one of the light-emitting diodes and the capacitor, a second driving stage to apply a current from the capacitor to the at least one of the light-emitting diodes, and a third driving stage to apply the current from the rectified voltage to the light-emitting diodes; and during a second period of the rectified voltage before the first periods, the LED driver is configured to perform the first driving stage, without performing the second driving stage and the third driving stage.

* * * * *